US007786959B2

(12) United States Patent
Numao

(10) Patent No.: US 7,786,959 B2
(45) Date of Patent: Aug. 31, 2010

(54) DISPLAY APPARATUS

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1166 days.

(21) Appl. No.: 11/129,297

(22) Filed: May 16, 2005

(65) Prior Publication Data

US 2005/0275647 A1 Dec. 15, 2005

(30) Foreign Application Priority Data

Jun. 14, 2004 (JP) ..... 2004-175867
Dec. 20, 2004 (JP) ..... 2004-368434

(51) Int. Cl.
*G09G 3/30* (2006.01)

(52) U.S. Cl. ..... 345/76; 345/204

(58) Field of Classification Search ..... 345/76, 345/204

See application file for complete search history.

(56) References Cited

U.S. PATENT DOCUMENTS

| | | | | |
|---|---|---|---|---|
| 6,891,520 | B2 * | 5/2005 | Chen et al. | 345/82 |
| 7,009,590 | B2 * | 3/2006 | Numao | 345/76 |
| 2003/0117352 | A1 | 6/2003 | Kimura | |
| 2003/0137503 | A1 * | 7/2003 | Kimura et al. | 345/212 |
| 2003/0197667 | A1 | 10/2003 | Numao | |
| 2004/0080474 | A1 * | 4/2004 | Kimura | 345/82 |
| 2004/0100427 | A1 * | 5/2004 | Miyazawa | 345/76 |
| 2008/0284312 | A1 | 11/2008 | Kimura | |

FOREIGN PATENT DOCUMENTS

| | | |
|---|---|---|
| JP | 2003-108067 | 4/2003 |
| JP | 2003-122306 | 4/2003 |
| JP | 2003-173165 | 6/2003 |
| JP | 2003-202834 | 7/2003 |
| JP | 2003-223138 | 8/2003 |
| JP | 2003-288049 | 10/2003 |

(Continued)

OTHER PUBLICATIONS

"4.0-in. TFT-OLED Displays and a Novel Digital Driving Method", 36.4L, Late-News Paper, SID'00 Digest, pp. 924-927.

(Continued)

*Primary Examiner*—Henry N Tran
*Assistant Examiner*—Viet Pham
(74) *Attorney, Agent, or Firm*—Harness, Dickey & Pierce, P.L.C.

(57) ABSTRACT

When the transistor Q3 is OFF, a predetermined potential is supplied to a potential wire Ui such that a switching transistor Q2 becomes ON. This changes a gate potential of a driving transistor Q1 from an ON potential to a threshold potential. Thereafter, the transistor Q2 is turned OFF, with the result that the potential of the potential wire Ui is changed (in cases where the transistor Q1 is a p-type transistor, the potential is decreased). With this, the transistor Q1 allows a current to constantly flows therethrough, irrespective of the threshold potential. This shortens time for setting an output current of the driving TFT for driving a current driving type display element.

15 Claims, 29 Drawing Sheets

FOREIGN PATENT DOCUMENTS

| | | | |
|---|---|---|---|
| JP | 2004-004501 (A) | | 1/2004 |
| JP | 2004-069816 (A) | | 3/2004 |
| JP | 2004-271899 (A) | | 9/2004 |
| WO | WO 98/48403 | A1 | 10/1998 |
| WO | WO 9848403 | A1 * | 10/1998 |
| WO | WO 01/75852 | A1 | 10/2001 |
| WO | WO 2004/013834 | A1 | 2/2004 |

OTHER PUBLICATIONS

"Continuous Grain Silicon Technology and Its Applications for Active Matrix Display", AM-LCD 2000, pp. 25-28.

"Polymer Light-Emitting Diodes for use in Flat Panel Displays", AM-LCD'01, pp. 211-214.

* cited by examiner

FIG. 22

7bit+Blank

| | | OCCUPANCY PERIOD NUMBER | | | | | | | |
|---|---|---|---|---|---|---|---|---|---|
| BIT NUMBER | BIT WEIGHT | 0 | 1 | 2 | 3 | 4 | 5 | 6 | 7 |
| 6 | 20 | ● | | | | | | | |
| 5 | 15 | | | | | ● | | | |
| 1 | 2 | | | | ● | | | | |
| 0 | 1 | | | | | | ● | | |
| 2 | 4 | | | | | | | ● | |
| 3 | 7 | | | ● | | | | | |
| 4 | 14 | | ● | | | | | | |
| E | 0 | | | | | | | | ● |
| TOTAL | 63 | | | | | | | | |

| THE NUMBER OF SELECTION LINES | THE NUMBER OF DATA | SCANNING PERIOD | LIGHT-EMITTING PERIOD | DIFFERENCE | LIGHT-EMITTING RATIO |
|---|---|---|---|---|---|
| 8 | 8 | 64 | 63 | 1 | 98.44% |

TIMINGS FOR DRIVING IN ACCORDANCE WITH TIME-DIVISION GRADATION (FIRST HALF)

TIMINGS FOR DRIVING IN ACCORDANCE WITH TIME-DIVISION GRADATION (LATTER HALF)

FIG. 25

9bit+Blank

| | | OCCUPANCY PERIOD NUMBER | | | | | | | | | |
|---|---|---|---|---|---|---|---|---|---|---|---|
| ORDER | BIT WEIGHT | 0 | 1 | 2 | 3 | 4 | 5 | 6 | 7 | 8 | 9 |
| 8 | 82 | ● | | | | | | | | | |
| 7 | 62 | | | ● | | | | | | | |
| 5 | 32 | | | | | ● | | | | | |
| 1 | 2 | | | | | | | ● | | | |
| 0 | 1 | | | | | | | | | ● | |
| 2 | 4 | | | | | | | | | | ● |
| 3 | 8 | | | | ● | | | | | | |
| 4 | 16 | | ● | | | | | | | | |
| 6 | 48 | | | | | | | | ● | | |
| E | 0 | | | | | | ● | | | | |
| TOTAL | 255 | | | | | | | | | | |

| THE NUMBER OF SELECTION LINES | THE NUMBER OF DATA | SCANNING PERIOD | LIGHT-EMITTING PERIOD | DIFFERENCE | LIGHT-EMITTING RATIO |
|---|---|---|---|---|---|
| 26 | 10 | 260 | 255 | 5 | 98.08% |

FIG. 28

8bit

| | | OCCUPANCY PERIOD NUMBER | | | | | | | |
|---|---|---|---|---|---|---|---|---|---|
| BIT NUMBER | BIT WEIGHT | 0 | 1 | 2 | 3 | 4 | 5 | 6 | 7 |
| 6 | 507 | ● | | | | | | | |
| 5 | 468 | | | | ● | | | | |
| 4 | 429 | | | | | | | | ● |
| 1 | 78 | | | | | ● | | | |
| 0 | 39 | | | ● | | | | | |
| 2 | 156 | | ● | | | | | | |
| 3 | 273 | | | | | | ● | | |
| 7 | 546 | | | | | | | ● | |
| | | ● | | | | | | | |
| TOTAL | 2496 | | | | | | | | |

| THE NUMBER OF SELECTION LINES | THE NUMBER OF BITS | SCANNING PERIOD | MAXIMUM LIGHT-EMITTING PERIOD | DIFFERENCE | LIGHT-EMITTING RATIO |
|---|---|---|---|---|---|
| 320 | 8 | 2560 | 2457 | 64 | 95.98% |

FIG. 29

10bit

| | | OCCUPANCY PERIOD NUMBER | | | | | | | | | |
|---|---|---|---|---|---|---|---|---|---|---|---|
| BIT NUMBER | BIT WEIGHT | 0 | 1 | 2 | 3 | 4 | 5 | 6 | 7 | 8 | 9 |
| 8 | 572 | ● | | | | | | | | | |
| 5 | 352 | | | ● | | | | | | | |
| 2 | 44 | | | | | ● | | | | | |
| 3 | 88 | | | | | | | | | ● | |
| 0 | 11 | | | | | | | ● | | | |
| 4 | 176 | | | | | | | | ● | | |
| 1 | 22 | | | | ● | | | | | | |
| 6 | 506 | | | | | | ● | | | | |
| 7 | 528 | | ● | | | | | | | | |
| 9 | 561 | | | | | | | | | | ● |
| | | ● | | | | | | | | | |
| TOTAL | 2860 | | | | | | | | | | |

| THE NUMBER OF SELECTION LINES | THE NUMBER OF BITS | SCANNING PERIOD | MAXIMUM LIGHT-EMITTING PERIOD | DIFFERENCE | LIGHT-EMITTING RATIO |
|---|---|---|---|---|---|
| 320 | 10 | 3200 | 2805 | 340 | 87.66% |

DISPLAY APPARATUS

This Nonprovisional application claims priority under 35 U.S.C. §119(a) on Patent Application No. 2004/175867 filed in Japan on Jun. 14, 2004, and on Patent Application No. 2004/368434 filed in Japan on Dec. 20, 2004, the entire contents of which are hereby incorporated by reference.

FIELD OF THE INVENTION

The present invention relates to a display apparatus including a driving circuit for driving a current driving type display element such as an organic EL (Electro Luminescence) and an FED (Field Emission Display).

BACKGROUND OF THE INVENTION

An organic EL element serving as a current driving type display element has such a well-known property that luminance depends on a current value, and that duration is short when the organic EL element is driven by a large current for attainment of a high luminance display. Developed for acquirement of a wider display screen and high definition in a display apparatus including such an organic EL element is an active matrix driving. Conventional passive matrix driving suffers from a difficulty in attainment of high luminance due to an increase in the number of scan lines, and from a decrease in duration due to momentary application of a very large current to pixels. For this reason, the passive matrix driving is implemented for relatively short-life use.

Incidentally, big problems of the active matrix driving are (i) current non-uniformity due to property variation of a thin film transistor (TFT), and (ii) uneven display luminance due to threshold voltage non-uniformity thereof. Other problems are (i) a decrease in luminance due to a deterioration of the organic EL with age, and (ii) a change (as temperature rises, the luminance rises) in luminance due to light emission (heat emission) of the organic EL. Now, a function for compensating such adverse properties has been required.

In order to solve the problems, various conventional driving circuit methods have been proposed. Examples of such methods include: (i) a voltage program method disclosed by Document 1 (WO98/48403, published on Oct. 29, 1998) and (ii) a current program method disclosed by Document 2 (WO01/07582; published on Oct. 11, 2001).

FIG. 20 is a circuit diagram illustrating a structure of a pixel circuit driven in accordance with the voltage program method. The pixel circuit shown in FIG. 20 is driven such that an analog voltage is applied from a data line 310 to the pixel circuit. With this, an output current of a transistor 365 (driving TFT) is programmed.

In the analog voltage program method, an initializing voltage (reference voltage) is applied from the data line 310 to a terminal of a capacitor 350, which terminal is toward a transistor 360 (switching TFT). This turns ON a transistor 370 (switching TFT), a transistor 375, and the transistor 365. Thereafter, the transistor 375 is turned OFF, and a threshold voltage correction is carried out with respect to the transistor 365. The threshold voltage correction requires several ten microseconds. Thereafter, the transistor 370 is turned OFF, and a desired voltage is applied to the terminal of the capacitor 350. With this, the output current of the transistor 365 is determined.

Because the threshold voltage variation in the respective transistor 365 is compensated as such, a constant driving current controlled according to the data voltage is supplied to an OLED 380 irrespective of the threshold voltage of the transistor.

Meanwhile, FIG. 21 illustrates a circuit diagram illustrating a structure of a pixel circuit driven in accordance with the above current program method. The pixel circuit is driven as follows. That is, a potential of a gate wire 42 is set at Low so as to turn ON transistors 32 and 37 (switching TFTs), and so as to turn OFF a transistor 33 (switching. TFT). Then, a current is supplied from a transistor 30 (driving TFT) to a row driving circuit (not shown; source driver) via a source wire 44. This allows a setting of a gate voltage of the transistor 30, and accordingly allows a setting of an output current of the transistor 30.

Thereafter, the gate wire 42 is set at High, and the transistors 32 and 37 are accordingly turned OFF, with the result that the gate voltage of the transistor 30 is maintained. Then, the transistor 33 is turned ON, and the current thus set is supplied to an organic EL 20.

Such a current program method allows compensation of (i) the threshold voltage variation of the transistor 30, and (ii) mobility variation of the transistor 30.

However, the driving method in Document 1 requires 60 microseconds or longer for the writing in each pixel. Supposing that a display is carried out with the use of a QVGA format (240×320 pixels) compliant display apparatus of portrait type (320 lines are vertically provided), and that a single frame period corresponds to 1/60 second, the writing in each pixel has to be carried out in 1/(320×60) second≈52 microseconds.

As such, the pixel circuit (see FIG. 20) takes time for the threshold correction of the driving TFT, and a display therefore cannot be attained in the required number of the pixels.

On the other hand, the current setting method disclosed by Document 2 also suffers from such a problem that the setting of the output current of the transistor 30 takes long time. Specifically, the source wire 44 has normally has a stray capacitance of several pF. Supposing that the stray capacitance is 10 pF and that a current value set for the transistor 30 is 0.1 μA, it takes 0.1 ms to change by 1 V, the voltage of the source wire 44. The threshold value of the transistor 30 of each pixel varies by on the order of 1V, so that the setting of the output current value requires 0.1 ms or longer.

Thus, the analog voltage driving method (see FIG. 20) and the analog current program method (see FIG. 21) requires such a long time for the setting of the output current from the driving TFT, so that a display cannot be attained in the required number of display pixels.

Such a problem is especially noticeable upon carrying out a time-division gradation display. In other words, for the acquirement of the time-division gradation display, the current setting is required to be carried out, within one frame period, with respect to transistors in pixels whose number corresponds to the number found by multiplying the gate wires by sub-frames.

SUMMARY OF THE INVENTION

The present invention is made to provide a driving circuit of a current driving type display element, whereby time required for the setting of the output current of the driving TFT is appropriately secured such that the time-division gradation display is attained, and whereby a display is attained in the required number of pixels.

To achieve the object, a first display apparatus of the present invention includes: (i) a plurality of pixels, provided in a matrix manner, each of the pixels including a current driving type display element; (ii) selection lines for supplying a selection signal for selecting the pixels; and (iii) data lines for supplying data to selected pixels, each of the pixels including: (i) a first transistor for controlling a current; (ii) a second transistor, provided in series with the first transistor and the display element, for supplying or stopping supplying of a current to the display element; (iii) a current setting circuit for setting an output current of the first transistor; and (iv) a driving circuit for turning ON or OFF of the second transistor so as to carry out a time-division gradation driving, the current setting circuit setting of the output current of the first transistor during a period in which the second transistor is OFF, the second transistor being turned OFF in response to OFF data, at least one of driving data, for use in the time-division gradation driving, being the OFF data.

As such, the second transistor is used for the time-division gradation display, and receives the OFF data that is a part of the time-division gradation data. While the second transistor is OFF, the setting of the output current of the first transistor is carried out. Therefore, the second transistor can be used both for (i) the time-division gradation display and (ii) the setting of the output current of the first transistor. This allows reduction of the required number of transistors.

Further, the period during which the second transistor is OFF continues for (i) several selection periods or longer; or (ii) several selection periods plus a period shorter than one selection period, or longer. Such a period is sufficient for the setting of the output current of the first transistor even though each selection period is required to be short for the sake of the time-division gradation display.

The first display apparatus is a display apparatus that carries out the time-division gradation driving in accordance with turning ON/OFF of the second transistor, and is so set that a current constantly flows through the first transistor while the second transistor is OFF. This appropriately secures not only time required for the setting of the output current of the driving transistor for attainment of the time-division gradation display, but also the required number of pixels for the display.

A second display apparatus of the present invention includes: (i) a plurality of pixels, provided in a matrix manner; each including a current driving type display element; (ii) selection lines for supplying a selection signal for selecting the pixels; and (iii) data lines for supplying data to selected pixels, each of the pixels including: (i) a first transistor for controlling a current; (ii) a second transistor, provided in series with the first transistor and the display element, for supplying or stopping supplying of a current to the display element; (iii) a current setting circuit for setting an output current of the first transistor; (iv) a driving circuit for turning ON or OFF of the second transistor so as to carry out a time-division gradation driving; and (v) a third transistor provided in series with the second transistor, the current setting circuit setting the output current of the first transistor while the third transistor is OFF.

As such, the third transistor is provided in series with the second transistor, so that the output current of the first transistor can be set irrespective of whether the second transistor is ON or OFF.

The period during which the third transistor is OFF continues for several selection periods or longer, so that such a period is sufficient for the setting of the output current of the first transistor even though each selection period is required to be short for the sake of the time-division gradation display.

The second display apparatus is a display apparatus that carries out the time-division gradation driving in accordance with turning ON/OFF of the second transistor, and is so set that a current constantly flows through the first transistor while the third transistor is OFF. This appropriately secures not only time required for the setting of the output current of the driving transistor for attainment of the time-division gradation display, but also the required number of pixels for the display.

As described above, each of the first display apparatus and the second display apparatus of the present invention is such a display apparatus that carries out the matrix driving with respect to a current driving type display element in accordance with time-division digital gradation driving. Moreover, each of the first display apparatus and the second display apparatus makes it possible to shorten time required for setting a current, which is to be flowing into the organic EL element, by way of the driving TFT. For this reason, the first display apparatus and the second display apparatus can be suitably used for a display device using a current driving type display element.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 22 is a diagram illustrating respective weights of sets of driving data used in a time-division gradation driving method used in Embodiment 1.

FIG. 25 is a diagram illustrating respective another weights of sets of driving data used in a time-division gradation driving method used in Embodiment 1.

FIG. 28 is a diagram illustrating respective weights of sets of driving data used in a time-division gradation driving method used in Embodiment 6.

FIG. 29 is a diagram illustrating respective another weights of sets of driving data used in a time-division gradation driving method used in Embodiment 6.

DESCRIPTION OF THE EMBODIMENTS

Embodiments of the present invention will be described below with reference to FIG. 1 through FIG. 19, and FIG. 22 through FIG. 29.

A driving method according to each of Embodiments uses an organic EL element as an electric optical element, and is applied to an active matrix type display apparatus adopting a current control type driving method. In respective Embodiments, a driver circuit includes TFTs that each serve as switching elements and that are made of a semiconductor material, specifically, low temperature polycrystalline silicon or CG (continuous grain) silicon, and is provided in a display apparatus incorporated with a driver. Specifically, the driver circuit is provided in a substrate having a pixel circuit including the electric optical element.

References (1) "4.0-in. TFT-OLED Displays and a Novel Digital Driving Method", 34.6, Late-News Paper, SID'00 Digest, pp. 924-927, Semiconductor Energy Laboratory Co., Ltd.

(2) "Continuous Grain Silicon Technology and Its Applications for Active Matrix Display" AM-LCD 2000, pp. 25-28, Semiconductor Energy Laboratory Co., Ltd.

(3) "Polymer Light-Emitting Diodes for use in Flat panel Display" AM-LCD '01, pp. 211-214, Semiconductor Energy Laboratory Co., Ltd.

Note that a structure of each CG silicon TFT serving as a switching element, and manufacturing processes thereof are fully described in, for example, References (1) and (2) above, so that explanation thereof is omitted here. Note also that a structure of the organic EL element and manufacturing processes thereof are fully described in, for example, References (3), so that explanation thereof is omitted here.

Embodiment 1

Figure 2:
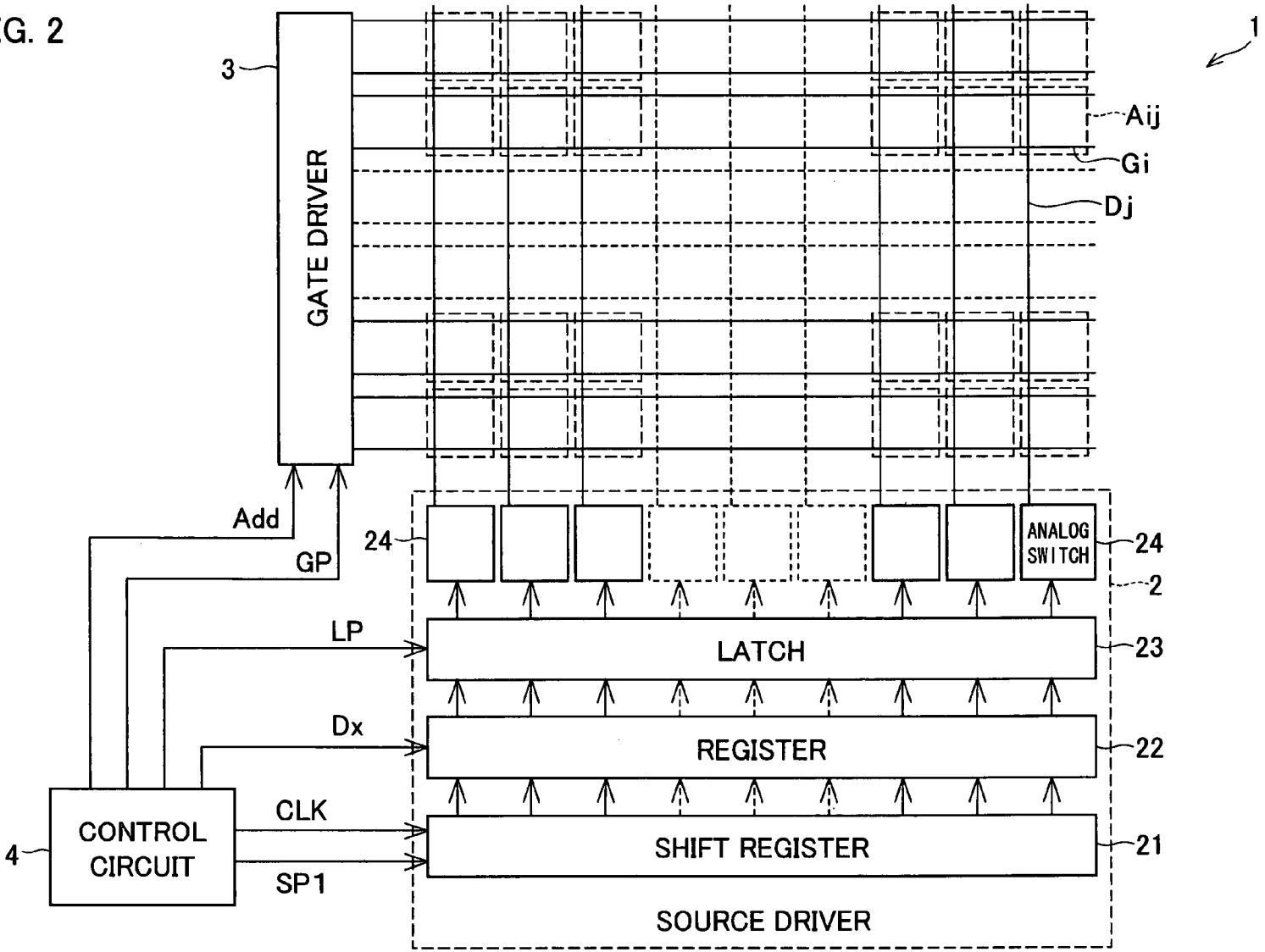
FIG. 2 is a block diagram illustrating a structure of an important part of the organic EL display apparatus of Embodiment 1.

Firstly, Embodiment 1 is explained. FIG. 2 is a block diagram illustrating an entire circuit structure of an organic EL display apparatus 1 of the present embodiment.

As shown in FIG. 2, the organic EL display apparatus 1 includes (i) a plurality of pixel circuits Aij (i=1 through m; j=1 through n), (ii) a source driver 2, and (iii) a gate driver 3.

Provided in the organic EL display apparatus 1 are (i) a plurality of data wires Dj (data lines) parallel to each other; and (ii) a plurality of scan wires Gi that are parallel to each other and that are perpendicular to the data wires Dj, respectively. In respective intersections of the data wires Dj and the scan wires Gj, the pixel circuits Aij (pixels) are provided in a matrix manner. The gate wires Dj are connected to a source driver 2, whereas the scan wires Gi are connected to a gate driver 3.

For size reduction of the entire display apparatus and manufacture cost reduction thereof, it is preferable that the drivers 2 and 3 be formed partially or wholly in the substrate having the pixel circuits Aij, and that the drivers 2 and 3 use the polycrystalline silicon TFTs or CG silicon TFTs. However, although the above effects are not obtained, the driver circuits 2 and 3 may be partially or entirely formed, as an IC, on a different substrate that the organic EL display apparatus 1 does not have, and may be externally connected to the organic EL display apparatus 1. For example, the driver circuits 2 and 3 may be manufactured in accordance with the COG (Chip On Glass) by which an IC is directly bonded on a glass substrate. Alternatively, the driver circuits 2 and 3 can be manufactured such that an IC provided on a flexible substrate is bonded to an input terminal and an output terminal provided on a substrate of the organic EL display apparatus 1.

The source driver 2 includes a shift register 21, a register 22, a latch 23, and analog switches 24.

In the source driver 2, the shift register 21 receives a start pulse SP1 from a control circuit 4, and transfers the start pulse SP1 in synchronization with a clock CLK, and outputs the start pulse SP1, as a timing signal, from respective output stages. The register 22 is constituted by a plurality of flip flops, and retains input digital image data Dx in each of the flip flops in accordance with a corresponding timing signal sent from the shift resister 21. The latch 23 transfers, to each analog switch 24 in accordance with a latch pulse LP, the digital image data Dx that is retained in the register 22 and that corresponds to one line.

The analog switch 24 is provided for each of the data wires Dj. The analog switch 24 supplies a voltage for turning ON a transistor Q3 (see FIG. 1; described later) of each pixel circuit Aij, when the digital image data Dx is "High". Whereas, when the digital image data Dx is "Low", the analog switch 24 supplies a voltage for turning OFF the transistor Q3.

The control circuit 4 is a circuit for outputting the start pulse SP1, the clock CLK, the latch pulse LP, and the digital image data Dx. Further, the control circuit 4 outputs a gate pulse GP and an address signal Add.

The gate driver 3 includes an address decoder circuit, and decodes the address signal Add with the use of the address decoder so as to give a selection pulse to a corresponding output stage. The gate pulse GP is a signal used together with the selection pulse so that the gate driver 3 outputs the logical product of the gate pulse GP and the selection pulse. This prevents an indeterminate signal, which is still being subjected to the address decoding, from being sent to the scan lines Gi. The gate driver 3 receives these signals, and sends a scan signal from the output stages to the scan wires Gi. With this, the scan wires Gi is so selected as to be ready for a writing to be carried out during each of horizontal scanning periods. Moreover, the gate driver 3 supplies a potential having a predetermined level to each of a potential wire Ui, and control wires Ci, Pi, Ri, and Wi, as described later. The supply of the potential is carried out in accordance with the address signal Add for providing various timings.

Figure 1:
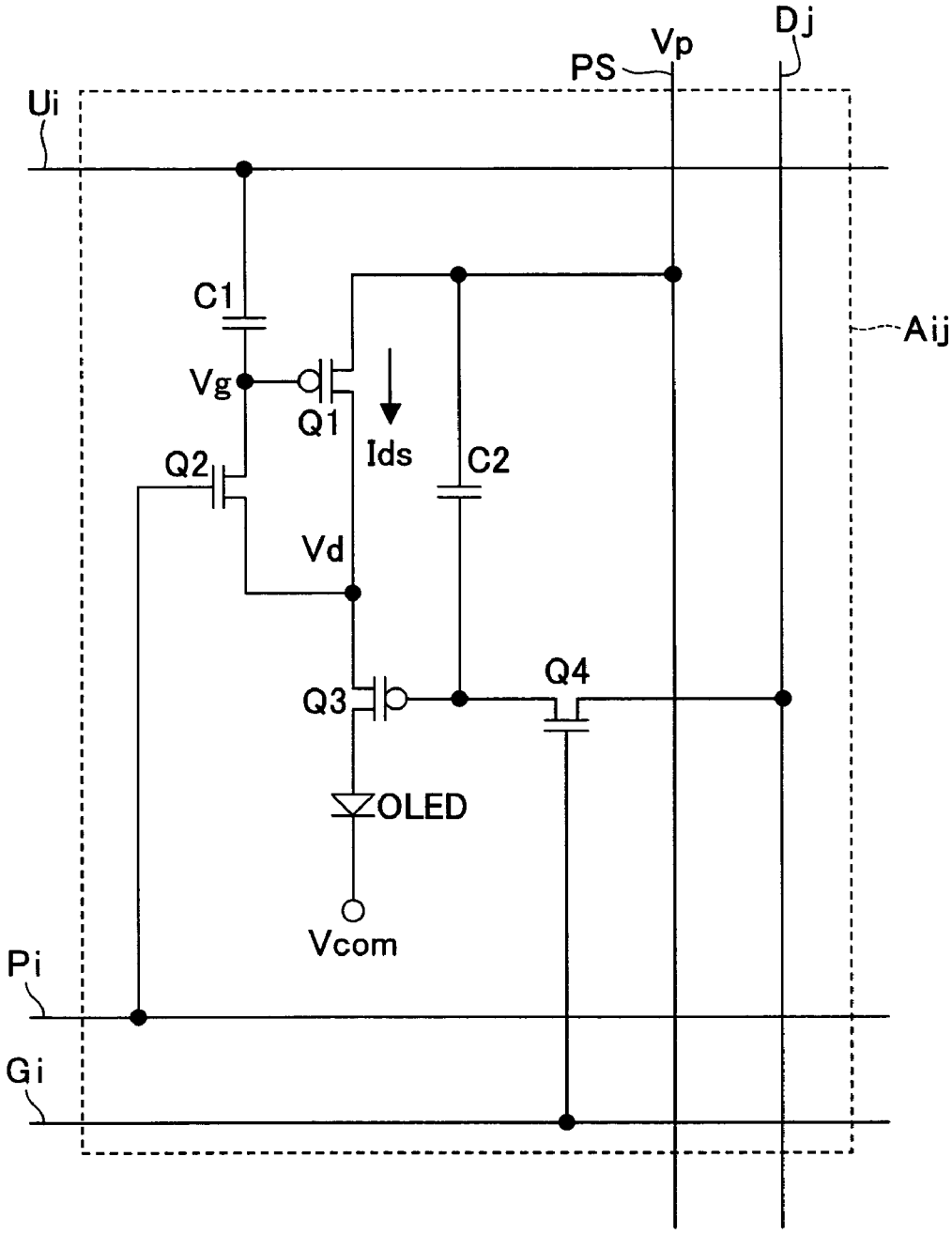
FIG. 1 is a circuit diagram illustrating a structure of a pixel circuit in an organic EL display apparatus of Embodiment 1 of the present invention.

FIG. 1 is a circuit diagram illustrating a structure of each of the pixel circuits Aij of the present embodiment.

As shown in FIG. 1, the pixel circuit Aij includes an organic EL element OLED, transistors Q1 through Q4, and capacitors C1 and C2. Each of the transistors Q1 through Q4 is a TFT made of polycrystalline silicon or CG silicon, and the transistors Q1 (first transistor) and Q3 (second transistor) are driving transistors. The pixel circuit Aij has such a circuit structure that the transistor Q1, the transistor Q3, and the organic EL element OLED (display element) are provided in series between (i) a power supply wire PS for applying a power voltage Vp, and (ii) a common electrode for applying a common voltage Vcom.

The organic EL element OLED serves as an electric optical element, and is provided in the vicinity of an intersection point of the data wire Dj and the scan wire Gi. Provided as an anode of the organic EL element is a pixel electrode made of ITO or the like. Whereas, provided as a cathode of the organic EL element is the common electrode to which the common voltage Vcom is applied. The transistor Q2 (third transistor) serves as a switching transistor, and is provided between a gate terminal of the transistor Q1 and a drain terminal thereof. Further, the capacitor C1 is provided between (i) the gate terminal of the transistor Q1 and (ii) the potential wire Ui. Further, the transistor Q2 has a gate terminal connected to the control wire Pi.

The transistor Q4 is a switching transistor, and is provided between (i) a gate terminal of the transistor Q3 and (ii) the data wire Dj. The capacitor C2 is provided between the gate terminal of the transistor Q3 and the power supply wire PS, and is a capacitor for accumulating time-division gradation digital data shown in FIG. 3. The capacitor C2 receives, from the data wire Dj, a binary potential such as 12 V (>Vp) and 0V (<Vp−|Vth|, Vth<0). The potential is accumulated in the capacitor C2, and is used for ON/OFF control of the transistor Q3. By carrying out such a potential setting a plurality of times during one frame period, the time-division gradation is realized. Moreover, this determines an output current of the transistor Q1.

Note that, in FIG. 1, the transistors Q1 and Q3 of the pixel circuit Aij are p-type TFTs, and the transistors Q2 and Q4 thereof are n-type TFTs.

Further, the potential wire Ui and the control wire Pi are connected to the gate driver 3 shown in FIG. 2. The power supply wire PS is connected to a DC power supply circuit (not shown).

Figure 3:
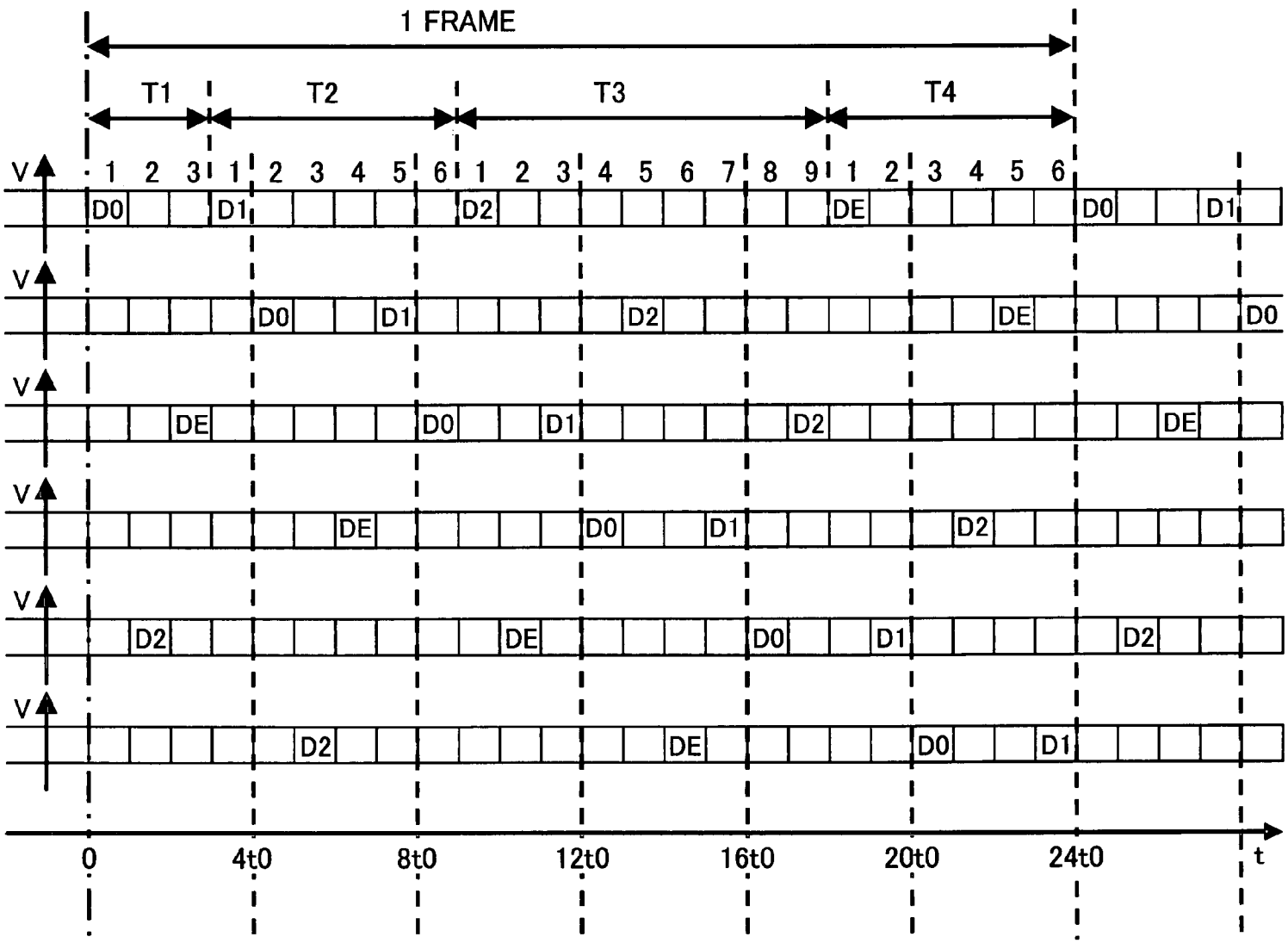
FIG. 3 is a diagram illustrating time-division gradation display data given to the pixel circuit connected to respective scan wires of the organic EL display apparatus.
Figure 4:
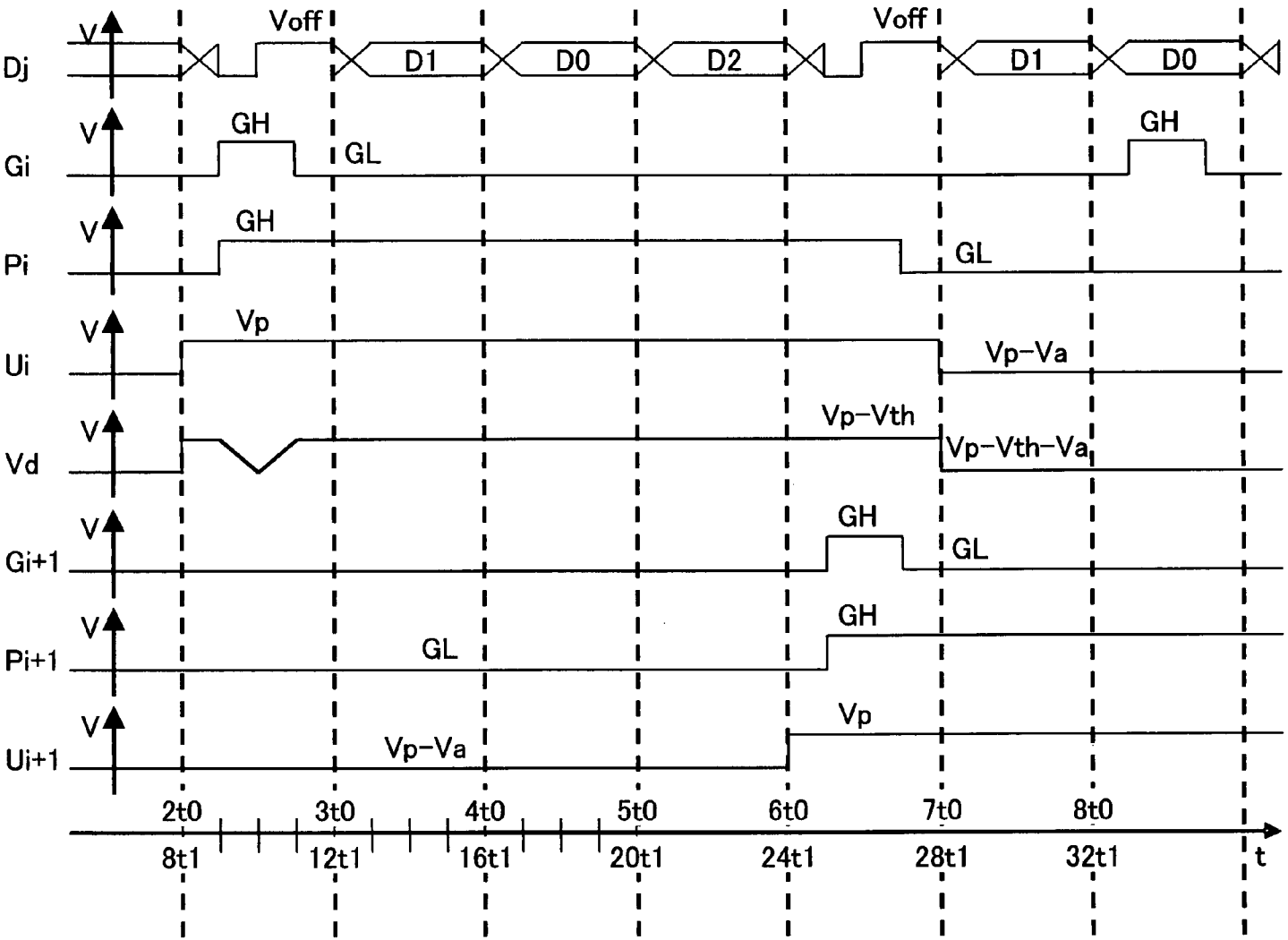
FIG. 4 is a timing chart illustrating an operation of setting an output current from a driving transistor of the pixel circuit.

The following explains an operation of setting the output current of the transistor Q1 of the pixel circuit Aij structured as above. The setting operation is carried out by the source driver 2 and the gate driver 3 under control of the control circuit 4. FIG. 3 is a diagram illustrating respective sets of time-division gradation display data supplied to the pixel circuits Aij connected to the scan wires. FIG. 4 is a timing chart illustrating the operation of setting the output current of the transistor Q1.

The potential supplied to the gate terminal of the transistor Q3 is the time-division gradation display data as shown in FIG. 3. For example, a scan wire G3 has an ON potential during a period of time from 2t0 to 3t0, and blanking data DE supplied from the source driver 2 to the data wire Dj is therefore sent to the transistor Q3 via the transistor Q4 (period of time from 2t0 to 3t0; see FIG. 4).

For acquirement of the time-division gradation display, an ON potential or an OFF potential is supplied to the gate terminal of the transistor Q3 via the transistor Q4 during such a period that each of the scan wires Gi has a High potential (potential GH, active potential) in FIG. 4. Note that each of D0, D1, and D2 in FIG. 3 indicates the ON potential (Low potential) or the OFF potential (High potential).

The operation of setting the output current of the transistor Q1 is carried out in the following manner. Firstly, the potential of the potential wire Ui is set at a predetermined potential Vp (V) (time 8t1 in FIG. 4), and a logical level of the control wire Pi is set at High (GH) such that the transistor Q2 becomes ON (time 9t1 in FIG. 4). Also, a logical level of the scan wire Gi is set at High such that the transistor Q3 becomes ON for a moment by an ON voltage applied from the source driver 2 to the gate terminal of the transistor Q3 (period of time from 8t1 to 9t1 in FIG. 4). Carried out immediately after the voltage application is application of a voltage for turning OFF the transistor Q3 (period of time from 9t1 to 10t1). As such, the operation is carried out, while the transistor Q4 is ON, by supplying the ON potential from the source driver 2 to the gate terminal of the transistor Q3 via the data wire Dj, and by supplying the OFF potential immediately after the supply of the ON potential.

On this occasion, the gate of the transistor Q1 and the drain thereof are short-circuited via the transistor Q2, so that the potential of the gate terminal of the transistor Q1 is decreased to be the ON potential. When the transistor Q3 is turned OFF after that as described above, a drain terminal potential Vd of the transistor Q1 is increased. This causes an increase in the gate terminal potential Vg of the transistor Q1, and the transistor Q1 accordingly becomes OFF. Note that a source-gate potential of the transistor Q1 on this occasion is regarded as a threshold potential of the transistor Q1.

Thereafter, the logical level of the control wire Pi is set at Low (GL) such that the transistor Q2 becomes OFF (time 27t1 in FIG. 4). Then, with the potential of the capacitor C1 maintained as it is, the potential of the potential wire Ui is changed (reduced by, e.g., Va (V)) to a predetermined potential (time 28t1 in FIG. 4). With this, the source-gate potential Vgs of the transistor Q1 is regarded as a threshold potential Vth−Va (V).

Note that, when the source-drain potential Vds and the source-gate potential Vgs of the transistor Q1 satisfy |Vds|≧|Vgs|, a current I flowing through the TFT is represented by the following equation:

$$I=k\times\mu\times(Vgs-Vth)^2$$

where |Vgs−Vth|<|Vgs| is satisfied and where Vth indicates the threshold potential. Moreover, the transistor Q1 is a p-type transistor, so that Vth has a negative value. Accordingly, a current Ids flowing through the transistor Q1 is represented by the following equation:

$$Ids=k\times\mu\times(Va)^2$$

As such, the current flowing through the transistor Q1 can be set by compensating the variation of the threshold of the transistor Q1. When the transistor Q3 becomes ON, the driving current Ids thus set flows from the transistor Q1 to the organic EL element OLED via the transistor Q3.

In the time-division gradation display using the above structure, a ratio of weights of the display data is 1:2: . . . : 0. The last "0" indicates that the pixel is temporarily caused to stop emitting light in any gradation. For example, in the scanning timings shown in FIG. 3, the data DE corresponds to "0". In other words, in FIG. 3, the ratio of the weights of the respective data is: D0:D1:D2:DE=1:2:3:0.

Figure 5:
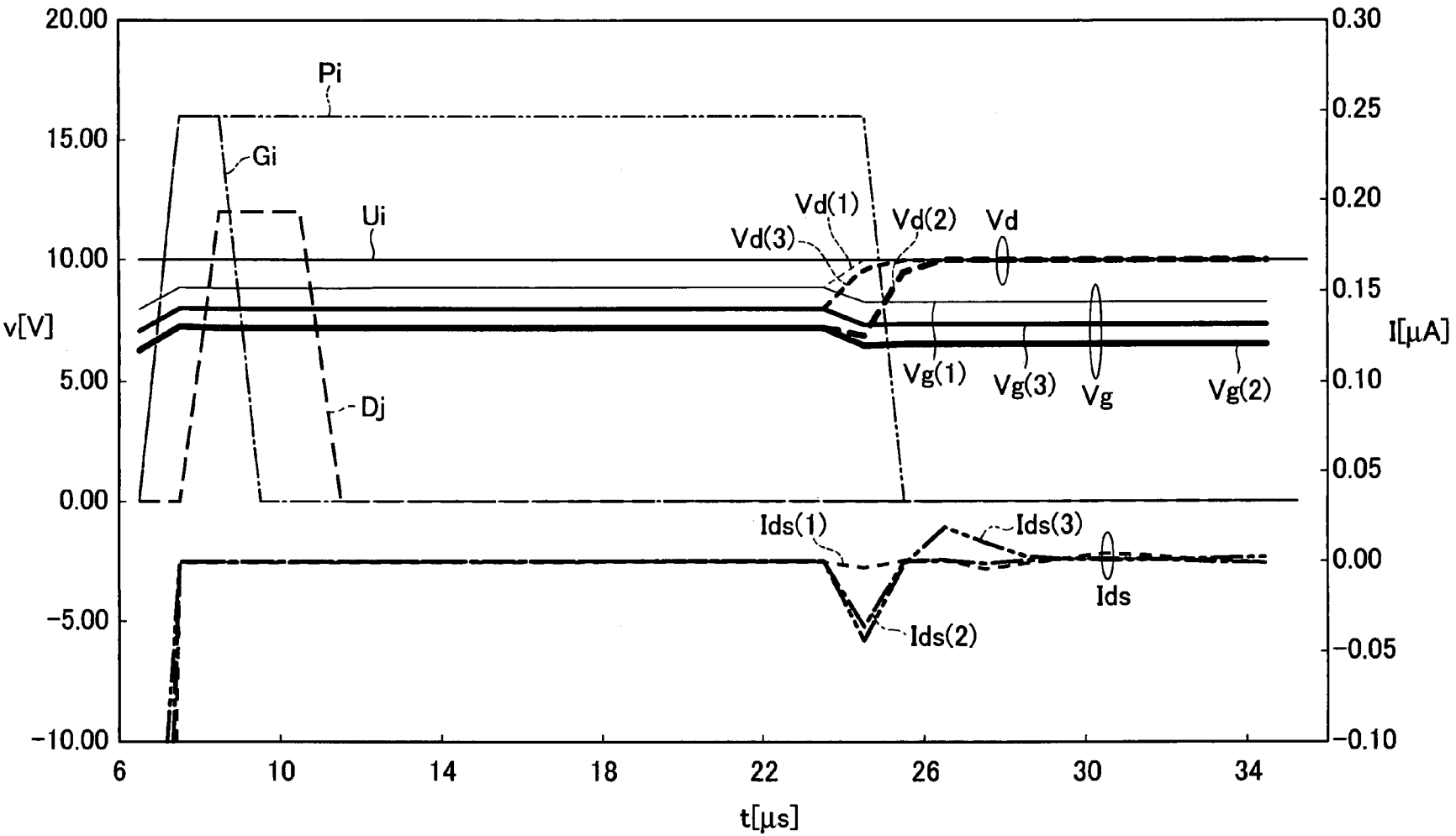
FIG. 5 is a diagram illustrating a result of a simulation of an operation of setting a gate potential of the driving transistor, the operation being carried out by changing (i) an current Ids flowing through the driving transistor, (ii) a gate terminal potential Vg, and (iii) a drain terminal potential Vd.

At such a timing (during a period of time from 2t0 to 8t0 in FIG. 3) that the pixel circuit Aij is forced to stop emitting light, an operation is carried out so as to set the potential Vg of the gate terminal of the transistor Q1 as shown in FIG. 4. Changed by the operation are: (i) the current Ids flowing through the transistor Q1, (ii) the gate terminal potential Vg, and (iii) the drain terminal potential Vd. FIG. 5 illustrates simulation results obtained by the change to the following states (1) through (3) in Table 1.

TABLE 1

| State | Mobility | Threshold |
|---|---|---|
| (1) | Maximum value of setting value | Minimum value of setting value |
| (2) | Minimum value of setting value | Maximum value of setting value |
| (3) | Center value of setting value | Center value of setting value |

See FIG. 5. As it is apparent from each value of the current Ids after the control wire Pi becomes Low, the current Ids flowing through the transistor Q1 is almost constant irrespective of the threshold voltage.

As it is also apparent from FIG. 4, the current setting period of each transistor Q1 in a plurality of pixels corresponds to a period during which the potential wire Ui is High, i.e., corresponds to a period of time from 2t0 to 7t0. As such, the setting period can be longer than a selection period (time t0 in FIG. 4) of each of the pixels.

In the structure of the present embodiment, once the transistor Q1 is turned ON, only the potential wire Ui is used during incoming threshold value correction periods (i.e., current setting periods). This allows each threshold value correction period to be as long as desired while the transistor Q3 is OFF (during a period of time from 2t0 to 8t0 in the case of the scan wire G3 of FIG. 3).

Therefore, a T4 period in the timings shown in FIG. 3 can be wholly used as the threshold correction period. The threshold correction period corresponds to, in terms of length, the sub-frame period during which the bit weight of the time-division gradation data is always 0, so that the threshold correction period can be as long as ⅓ of one frame period in an extreme case.

With this, the time for setting the output current of the transistor Q1 can be secured irrespective of the selection period. Therefore, the scan wires Gi can be driven as required. As such, the use of the means of the present embodiment obviously ensures that a display is attained in the required number of the pixels.

Here, FIG. 22 illustrates an example using such pixels and time-division gradation driving method described in US Patent Publication 2003/0197667 A1 or in Japanese Laid-Open Patent Publication *Tokukai* 2004-271899.

In FIG. 22, numerals in a section "BIT NUMBER" indicate order of displaying respective sets of driving data, and values in a section "BIT WEIGHT" indicate respective weights of the sets of the driving data D. Note that each weight of the sets of the driving data D indicates a length of a sub-frame.

The numerals 0 to 7 under a section "OCCUPANCY PERIOD NUMBER" indicate timings for supplying the driving data to the data wires Dj, respectively. Indicated by "●" is output driving data corresponding to a data period of a series of n-number of data periods.

Specifically, according to FIG. 22, the order of displaying the sets of the driving data is: D6, D5, D1, D0, D2, D3, D4, and DE. Moreover, the ratio of the weights of the driving data is: D6:D5:D1:D0:D2:D3:D4:DE=20:15:2:1:4:7:14:0.

Figure 23:
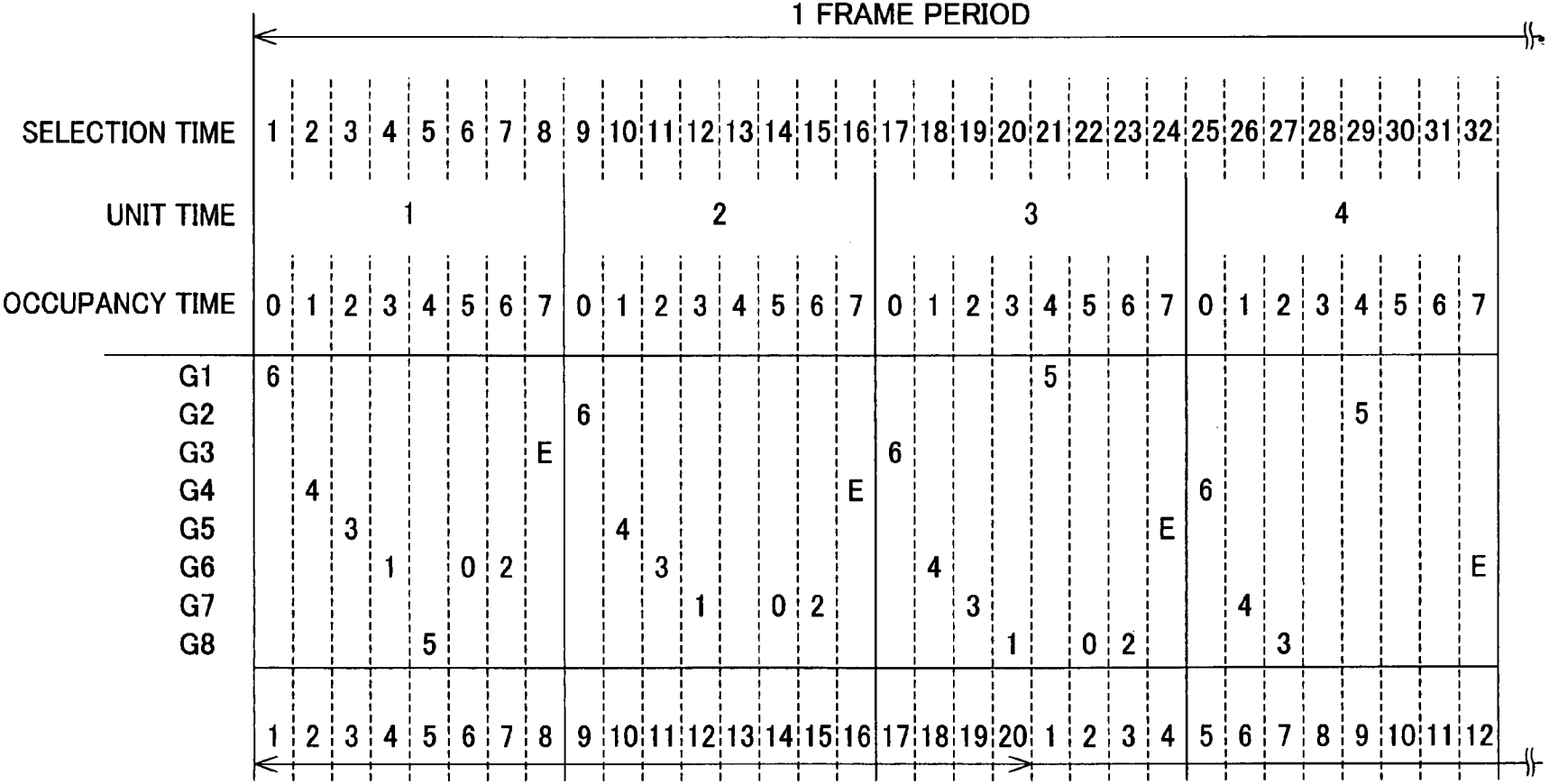
FIG. 23 is a timing chart illustrating a first half of timings for driving, with the use of the driving data (see FIG. 22), in accordance with the time-division gradation driving method.
Figure 24:
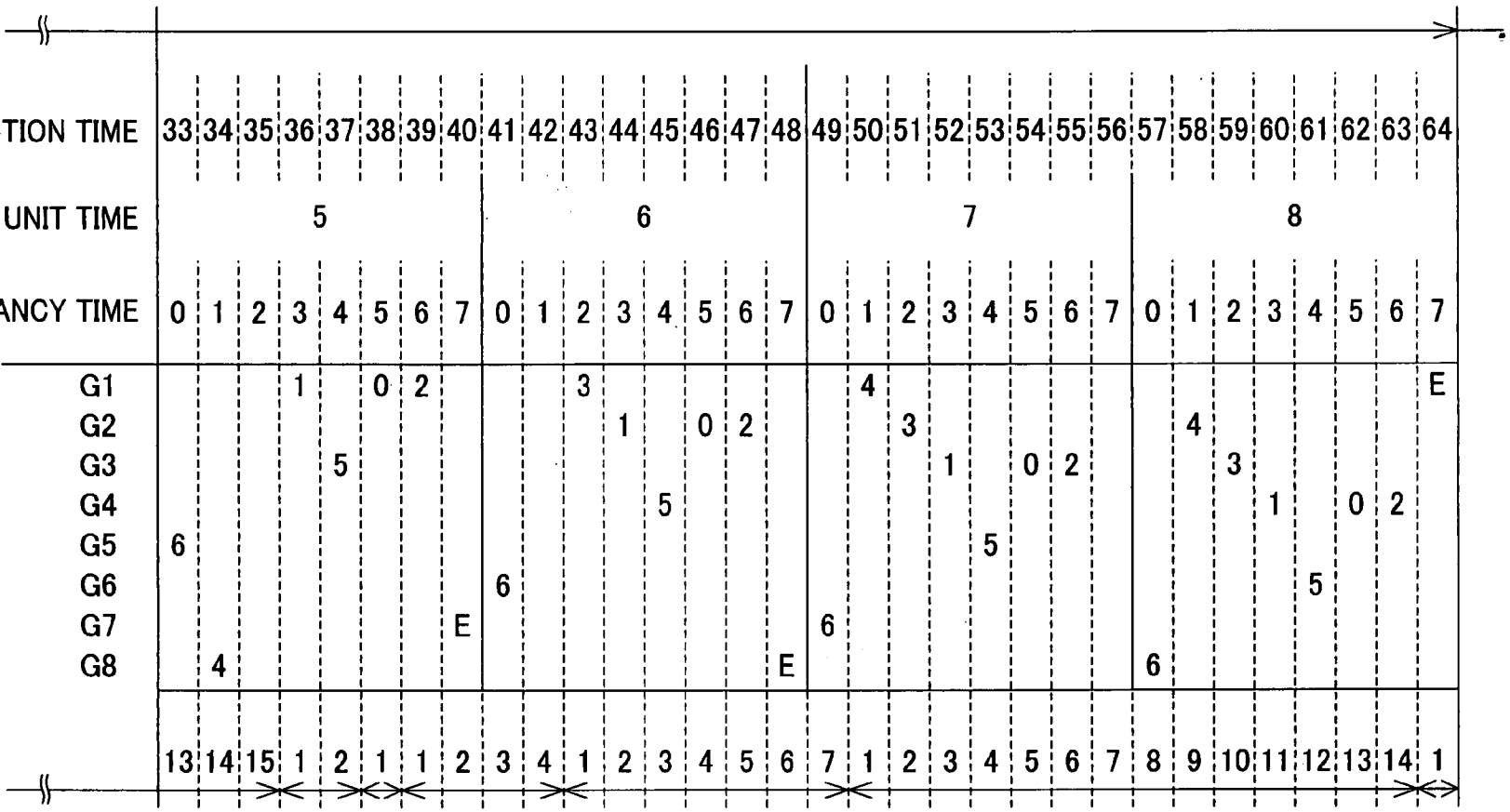
FIG. 24 is a timing chart illustrating a latter half of the timings for driving, with the use of the driving data (see FIG. 22), in accordance with the time-division gradation driving method.

In cases where the number of the scan wires Gi (selection lines) is eight, the driving data D0 through D7 corresponding to the selection line G1 are supplied to the data lines as shown in FIG. 23 and FIG. 24. Specifically, the driving data D6 is supplied to the data lines at a selection time 1, the driving data D5 being supplied to the data lines at a selection time 21, the driving data D1 being supplied to the data lines at a selection time 36, the driving data D0 being supplied to the data lines at a selection time 38, the driving data D2 being supplied to the data lines at a selection time 39, the driving data D3 being supplied to the data lines at a selection time 43, the driving data D4 being supplied to the data lines at a selection time 50, the driving data DE being supplied to the data lines at a selection time 64.

Each of the driving data D0 through D7 corresponding to the next selection line G2 is supplied at a timing eight selection periods after each supply of the driving data D0 through D7 corresponding to the selection line G1.

In this way, the driving data D0 through D7 corresponding to each of the selection lines G1 through G8 are supplied to the data lines during a period of the selection times from 1 to 64. FIG. 23 and FIG. 24 illustrate the supply, to the data wires Dj, of each driving data D corresponding to each of the selection lines Gi by way of the numerals in intersections of (i) sections indicating the selection times 1 through 64 and (ii) sections indicating the selection lines G1 through G8.

According to the order of the driving data D and the weights thereof in FIG. 22, successive eight data to be supplied to the data wires Dj respectively includes the driving data D0 through Dn-1, as shown in FIG. 23 and FIG. 24.

Note that sets of the driving data D corresponding to different selection lines Gi are never simultaneously supplied to each of the data wires Dj. Note also that a set of the driving data D is always supplied to the data wires Dj. This maximizes each selection time in cases where the same number of the driving data D are displayed. In contrast, in cases where the selection periods has the same length, a larger number of the driving data D can be displayed. This allows realization of a better multiple gradation display.

Likewise, see a case where the number of the driving data D is eight, and where the gradation of an image to be displayed is 64, and where the time-division gradation driving method described in US Patent Publication 2003/0197667 A1 is used. In this case, there are found many weight ratio patterns of the driving data D, i.e., such weight ratio patterns that the successive eight sets of the data to be supplied to the data wires Dj respectively include the driving data D0 through Dn-1. Examples of the patterns include: (i) D0:D1:D2:D3:D4:D5:D6:D7=14:15:4:1:2:7:20:0; (ii) D0:D1:D2:D3:D4:D5:D6:D7=14:14:1:4:2:7:21:0; (iii) D0:D1:D2:D3:D4:D5:D6:D7=14:14:7:2:4:1:21:0; and the like.

Further, see a case where the number of the sets of the driving data is ten, and where gradation of an image to be displayed is 256, and where the time-division gradation driving method described in Japanese Laid-Open Patent Publication *Tokukai* 2004-271899 is used. In this case, order of displaying the driving data D may be: D8, D7, D5, D1, D0, D2, D3, D4, D6, and DE. Ratio of the driving data may be: D8:D7:D5:D1:D0:D2:D3:D4:D6:DE=82:62:32:2:1:4:8:16:48:0, as shown in FIG. 25.

Furthermore, see a case where the number of the driving data D is ten, and where gradation of an image to be displayed is 256, and where the time-division gradation driving method described in US Patent Publication 2003/0197667 A1 is used. In this case, there are found many weight ratio patterns of the driving data D, i.e., such weight ratio patterns that successive ten data to be supplied to the data wires Dj respectively include the driving data D0 through Dn-1. Examples of the patterns include: (i) D0:D1:D2:D3:D4:D5:D6:D7:D8:D9=81:63:32:2:4:1:16:8:4:8:0; (ii) D0:D1:D2:D3:D4:D5:D6:D7:D8:D9=49:32:2:4:1:16:8:64:79:0; (iii) D0:D1:D2:D3:D4:D5:D6:D7:D8:D9=66:63:32:2:4:1:8:16:63:0; (iv) 64:32:2:4:1:8:16:62:66:0; and the like.

The longest sub-frame (sub-frame having a bit weight of 20) in the driving pattern shown in FIG. 22 is shorter than the longest sub-frame (sub-frame having a bit weight of 20) in the driving pattern described in Japanese Laid-Open Patent Publication Tokukai 2004-271899. Some researches indicate that shortening a length of the longest sub-frame is an effective way of restraining an occurrence amount of the dynamic false contours. Therefore, the driving using the driving pattern shown in FIG. 22 makes it possible to reduce the occurrence amount of the dynamic false contours, as compared with the driving using the driving pattern described in Japanese Laid-Open Patent Publication Tokukai 2004-271899.

Embodiment 2

Figure 6:
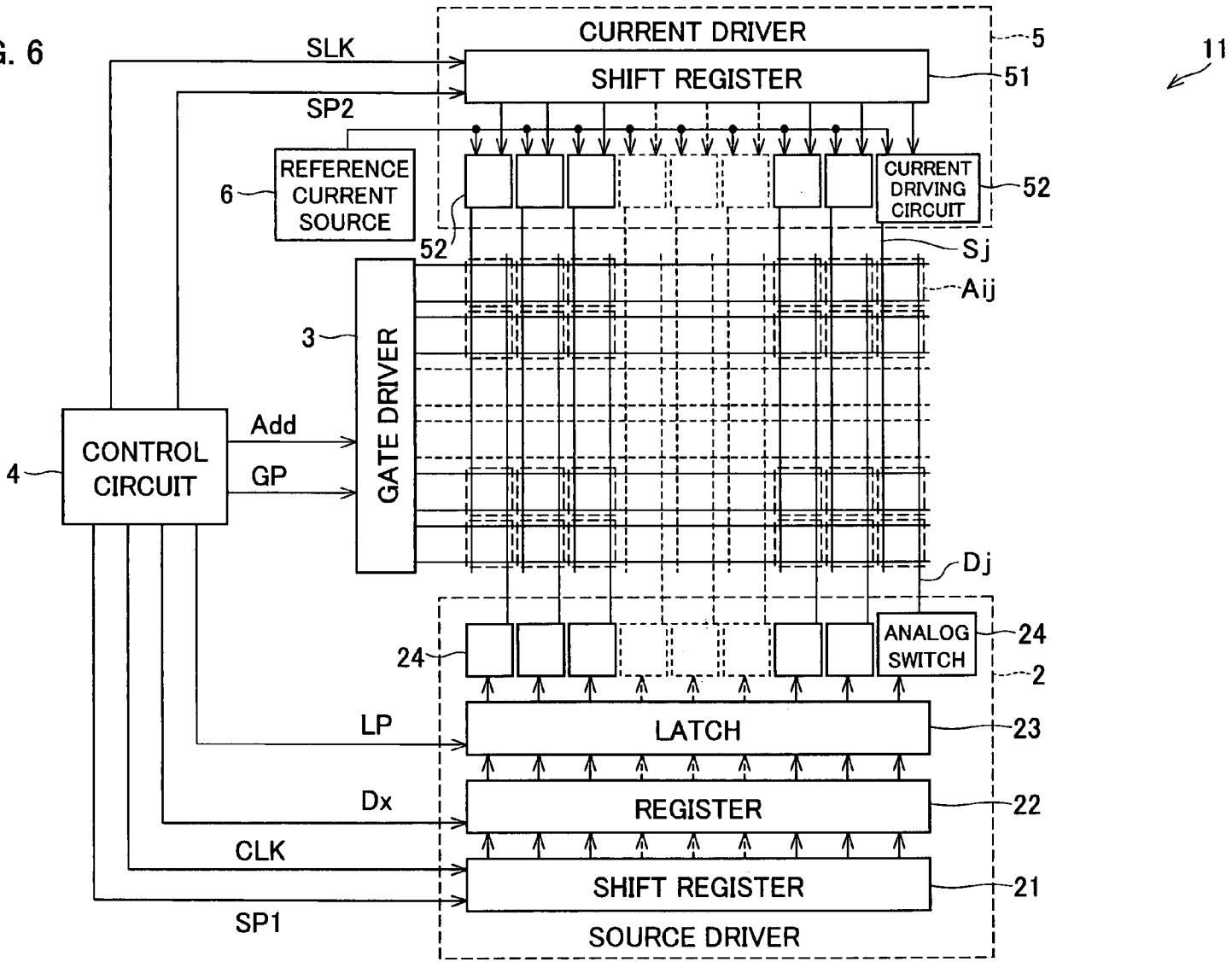
FIG. 6 is a block diagram illustrating a structure of an organic EL display apparatus of Embodiment 2 of the present invention.

Next, Embodiment 2 is explained. FIG. 6 is a block diagram illustrating an entire circuit structure of an organic EL display apparatus 11 of the present embodiment.

As is the case with the foregoing organic EL display apparatus 1, the organic EL display apparatus 11 includes (i) a plurality of pixel circuits Aij (i=1 through m; j=1 through n), (ii) a source driver 2, and (iii) a gate driver 3 as shown in FIG. 6. However, the original EL display apparatus 11 further includes a current driver 5 and a reference current source 6.

The current driver 5 includes a shift register 51 and a plurality of current driving circuits 52.

The shift register 51 receives a start pulse SP2 from a control circuit 4, and transfers the start pulse SP1 in synchronization with a clock SLK, and outputs the start pulse SP2, as a timing signal, from respective output stages. The clock SLK has a frequency f(SLK) that is different from a frequency f(CLK) of the aforementioned clock CLK (f(SLK)<<f(CLK)). Each of the current driving circuits 52 carries out (i) a current writing operation and (ii) a current outputting operation, in accordance with a timing signal received from the shift register 51. A structure of the current driver 5 will be explained in details later.

Figure 7:
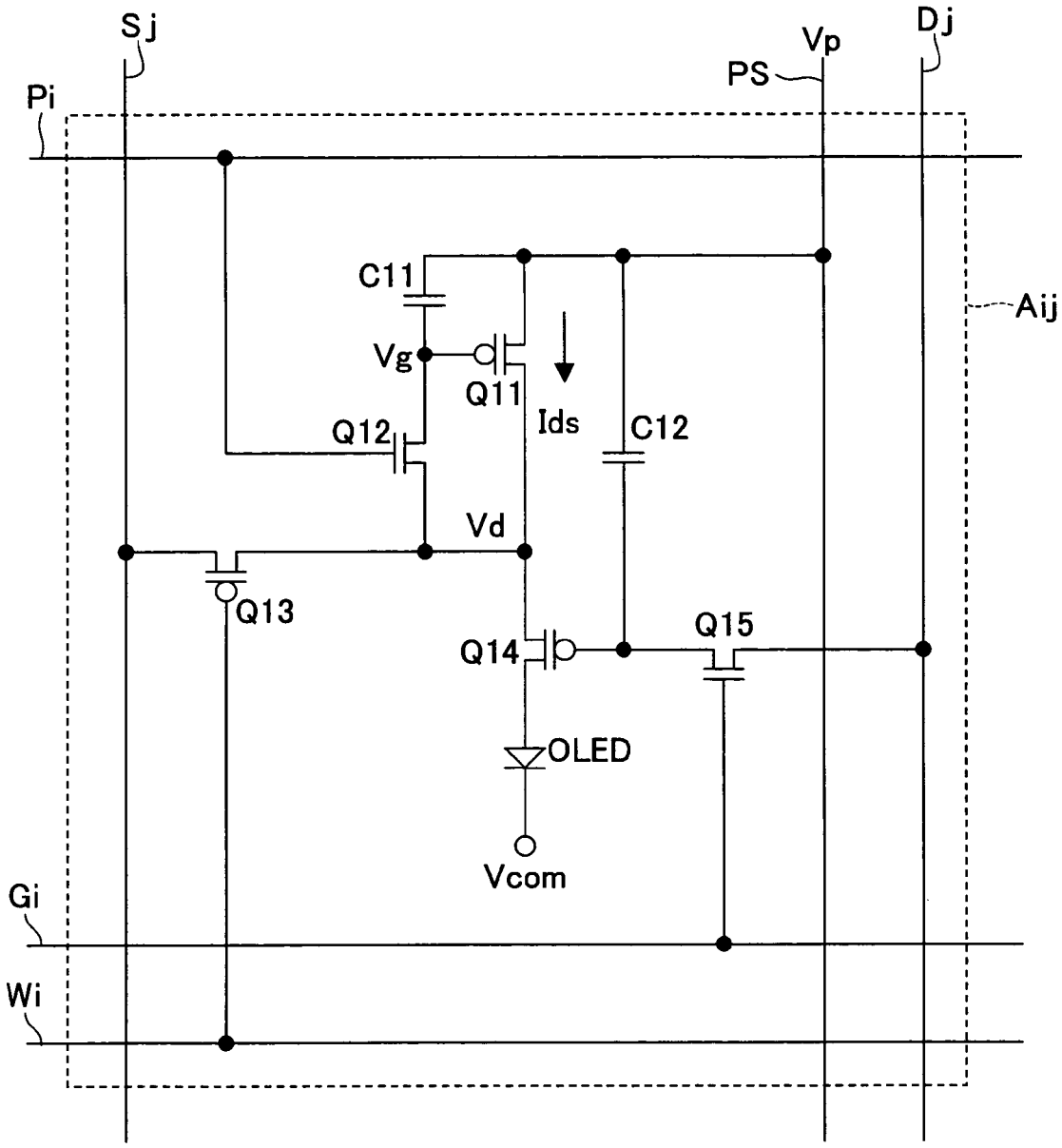
FIG. 7 is a circuit diagram illustrating a structure of a pixel circuit of the organic EL display apparatus of Embodiment 2 of the present invention.

FIG. 7 illustrates a circuit diagram illustrating each structure of the pixel circuits Aij of the present embodiment.

As shown in FIG. 7, the pixel circuit Aij includes (i) an organic EL element OLED, (ii) transistors Q11 through Q15, and capacitors C11 and C12. Each of the transistors Q11 through Q15 is a TFT made of polycrystalline silicon or CG silicon, and the transistors Q11 (first transistor) and Q14 (second transistor) are driving transistors. The pixel circuit Aij has such a circuit structure that the transistor Q11, the transistor Q14, and the organic EL element OLED (display element) are provided in series between (i) a power supply wire PS for applying a power voltage Vp, and (ii) a common electrode for applying a common voltage Vcom.

The organic EL element OLED is provided in the vicinity of an intersectional point of a data wire Dj and a scan wire Gi. Provided as an anode of the organic EL element OLED is a pixel electrode made of ITO or the like. Whereas, provided as a cathode of the organic EL element OLED is the common electrode to which the common voltage Vcom is applied. The transistor Q12 (third transistor) serves as a switching transistor, and is provided between a gate terminal of the transistor Q11 and a drain terminal thereof. Further, the capacitor C11 is provided between (i) the gate terminal of the transistor Q11 and (ii) a source terminal thereof. Further, the transistor Q12 has a gate terminal connected to a control wire Pi. The transistor Q13 (fourth transistor) is provided between (i) a node of the transistors Q11 and Q14, and (ii) a source wire Sj (current supply line). The transistor Q13 has a gate terminal connected to a control wire Wi.

The transistor Q15 (fifth transistor) is a switching transistor, and is provided between a gate terminal of the transistor 14 and the data wire Dj. Further, the capacitor C12 is provided between (i) the gate terminal of the transistor Q14 and (ii) the power supply line PS.

Note that, in FIG. 7, the transistors Q12 and Q15 in the pixel circuit Aij are n-type TFTs, and the transistor Q11, Q13, and Q14 are n-type TFTs; however, all the transistors Q11 through Q15 may be n-type TFTs as long as control signals are appropriately supplied by (i) providing the transistor Q12 between the gate terminal of the transistor Q11 and the power supply wire PS, and (ii) providing the capacitor C11 between the gate terminal of the transistor Q11 and the drain terminal thereof.

Further, the control wires Pi and Wi are connected to the gate driver 3 shown in FIG. 6. The gate driver 3 also supplies a potential having a predetermined level to the control wire Wi. The power supply wire PS is connected to a DC power supply circuit (not shown).

Figure 8:
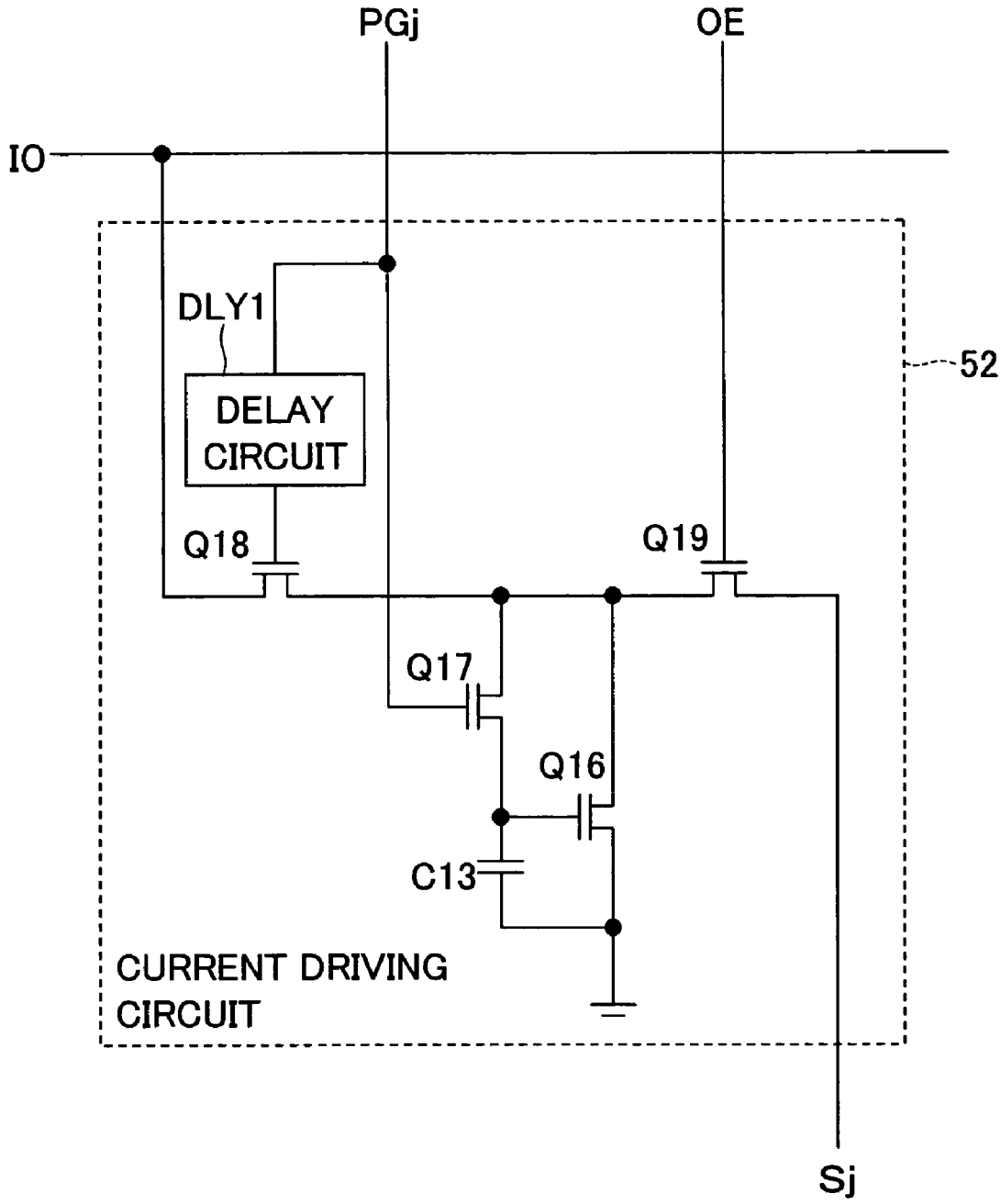
FIG. 8 is a circuit diagram illustrating a structure of a current driving circuit of the organic EL display apparatus of Embodiment 2 of the present invention.

FIG. 8 fully illustrates a structure of the current driving circuit 52. The current driving circuits 52 includes (i) transistor Q16 through Q19, each of which is an n-type TFT; (ii) a capacitor C13; and (iii) a delay circuit DLY1.

The delay circuit DLY1 has an input terminal for receiving a selection signal PGj sent from each output stage of the shift register 51. The delay circuit DLY1 is made up of a buffer circuit and the like, and outputs the received selection signal PGj with a delay of a predetermined time. The delay circuit DLY1 has an output terminal connected to a gate terminal of the transistor Q18. Note that the selection signal PGj is also sent to a gate terminal of the switching transistor Q17.

The transistor Q18 has a drain terminal that receives a reference current I0, and has a source terminal that is connected to respective drain terminals of the transistors Q16, Q17, and Q19. The transistor Q17 has a source terminal connected to the gate terminal of the transistor Q16. The transistor Q16 has a source terminal connected to GND. The capacitor 13 is provided between the gate terminal of the transistor Q16 and the source terminal thereof. The transistor Q19 has a gate terminal that receives an output enabling signal OE sent from a control circuit 4, and has a source terminal connected to the source wire Sj.

The delay circuit DLY1 is provided so that the transistor Q18 surely becomes OFF after the transistor Q17 becomes OFF. In cases where the transistor Q18 becomes OFF before the transistor Q17 becomes OFF, a current flowing through the transistor Q16 is changed from I0. This is not preferable.

Figure 9:
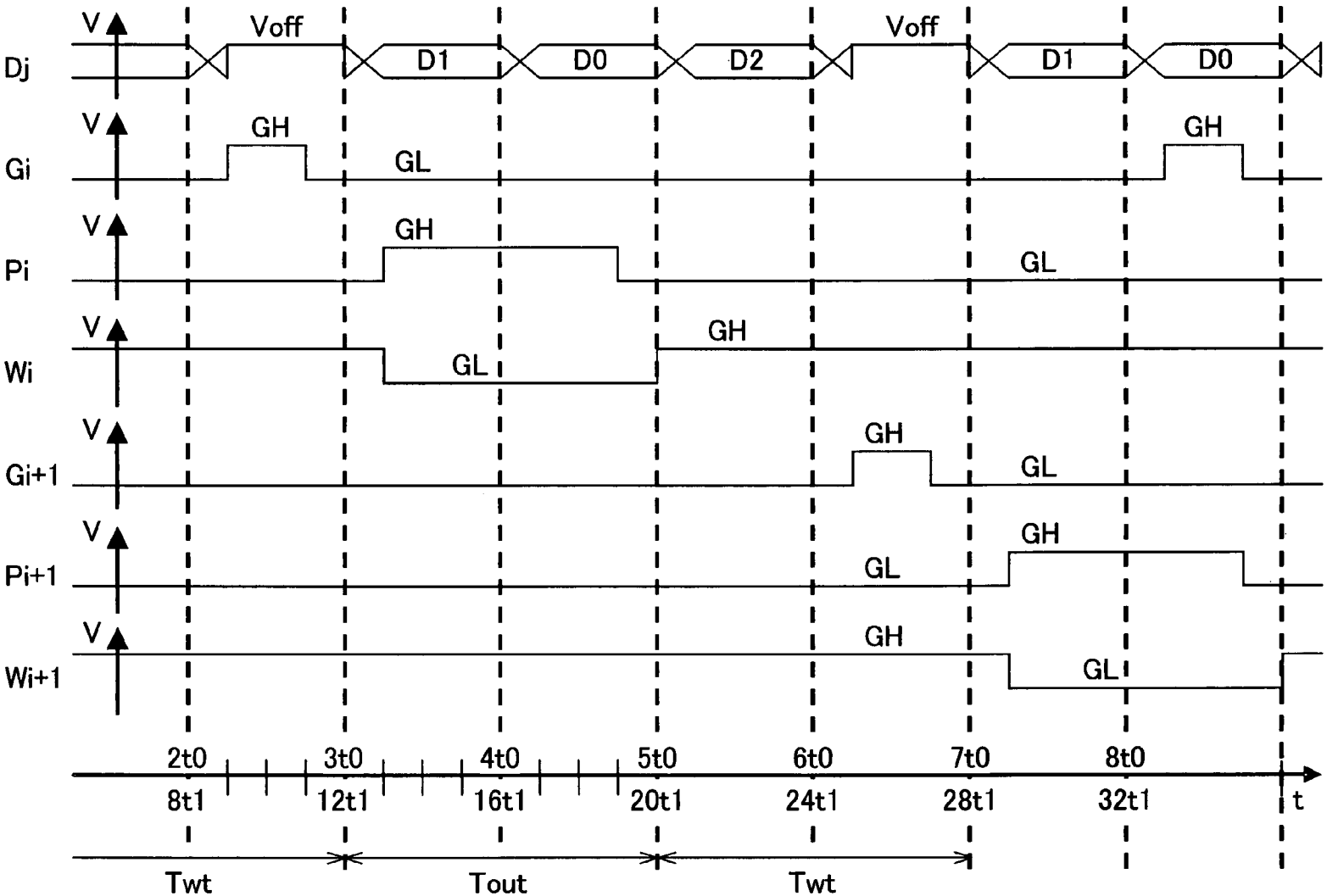
FIG. 9 is a timing chart illustrating an operation of setting an output current from a driving transistor of the pixel circuit shown in FIG. 7.

The following explains an operation of setting an output current of the transistor Q11 of the pixel circuit Aij structured as above. This setting operation is carried out by the source driver 2 and the gate driver 3 under control of the control circuit 4. FIG. 9 is a timing chart illustrating the operation of setting the output current of the transistor Q11.

Also in the present embodiment, a potential supplied to the gate terminal of the transistor Q14 is time-division gradation display data shown in FIG. 3. For example, a scan wire G3 has an ON potential during a period of time from 2t0 to 3t0, and blanking data DE supplied to the data wire Dj is therefore sent to the gate terminal of the transistor Q14 via the transistor Q15 (period of time from 9t1 to 11t1).

During such a period that the scan wire Gi has High potential (potential GH) in FIG. 9, an ON potential (Low potential) or an OFF potential (High potential) is supplied to the gate terminal of the transistor Q14 via the transistor 15 for acquirement of the time-division gradation display.

Firstly, the potential level of the scan wire Gi is set at "High" such that the transistor Q15 becomes ON (time 9t1 in FIG. 9), and an OFF potential is accordingly supplied from the source driver 2 to the gate terminal of the transistor Q14 via the data wire Dj and the transistor Q15. Next, the potential level of the scan wire Gi is set at "Low" such that the transistor Q15 becomes OFF (time 11t1 in FIG. 9), and that the transistor Q14 remains OFF. With this, the transistor Q14 is OFF during a period of time from 9t1 to 33t1.

Next, a potential level of the control wire Pi is set at "High", and a potential level of the control wire Wi is set at "Low" (time 13t1 in FIG. 9), thereby turning ON the transistors Q12 and Q13. This allows a predetermined current to flow from the transistor Q11 to the current driving circuit 52 via the transistor Q13 and the source wire Sj.

A value (hereinafter, the value of the current is also indicated by "I0") of the current I0 flowing through the transistor Q11 on this occasion is expressed by the following equation:

$$I0=k\times\mu\times(Vgs-Vth)^2$$

on condition that $|Vds|\geqq|Vgs|$ is satisfied where Vds indicates a potential (source-drain potential) between the source of the transistor Q11 and the drain thereof, and Vgs indicates a potential (source-gate potential) between the source of the transistor Q11 and the drain thereof. Further, in the foregoing equation, Vth indicates a threshold voltage of the transistor Q11, and has a negative value. Specifically speaking, the gate-source potential Vgs of the transistor Q11 is caused to have a value corresponding to the current I0.

Thereafter, a logical level of the control wire Pi is set at "Low" such that the transistor Q12 becomes OFF (time 19t1 in FIG. 9). With this, the gate-source potential Vgs of the transistor Q11 is retained in the capacitor C11. Thereafter, the transistor Q13 is turned OFF (a time 20t1 in FIG. 9).

In this way, the current flowing through the transistor Q11 can be determined. When the transistor Q14 is turned ON, a driving current Ids flows from the transistor Q11 to the organic EL element OLED via the transistor Q14.

Note that the transistor Q19 in the current driving circuit 52 is ON during the current outputting operation period Tout corresponding to a period of time from 3t0 to 5t0 in FIG. 9. On the other hand, the following operation is carried out during a current writing operation period Twt corresponding to a period of time from (i) 4×n×t0+t0, to (ii) 4×n×t0+3t0 in FIG. 9. That is, the current driving circuit 52 sequentially receives a selection signal PGj from the shift resister 51 such that the transistor Q18 and Q17 sequentially become ON (the transistor Q19 becomes OFF). Accordingly, the reference current I0 supplied from the reference current source 6 flows into the transistor Q16.

When a gate-source potential of the transistor Q16 is set according to the value of the reference current I0, the transistor Q17 is turned OFF for the purpose of maintaining the gate-source potential. This causes the current I0 to constantly flow into the source wire Sj. Thereafter, the transistor Q18 is turned OFF.

Figure 10:
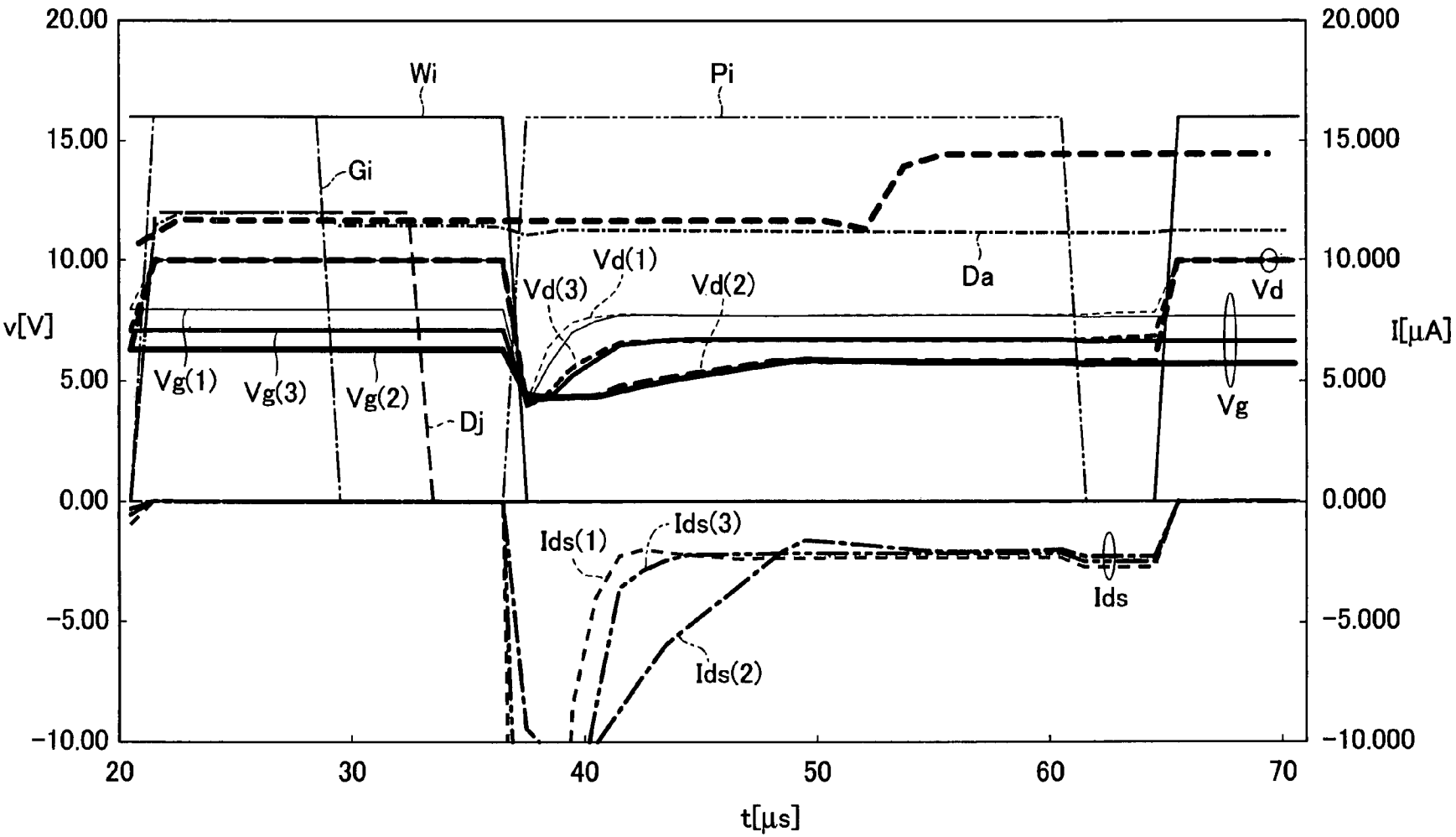
FIG. 10 is a diagram illustrating a result of a simulation of an operation of setting a gate potential of the driving transistor of the pixel circuit shown in FIG. 7, the operation being carried out by changing (i) an current Ids flowing through the driving transistor, (ii) a gate terminal potential Vg, and (iii) a drain terminal potential Vd.

FIG. 10 illustrates a simulation result obtained by changing, to the aforesaid states (1) through (3) in Table 1 during the above operation, the current Ids flowing through the transistor Q11, the gate terminal potential Vg of the transistor Q11, and the drain terminal potential Vd of the transistor Q11.

Apparently from FIG. 10, the current Ids flowing through the transistor Q11 is constant at a time (60 μs) just before the transistor Q12 becomes OFF by setting the control wire Pi at "Low". On this occasion, the transistor Q11 has the gate potential Vg corresponding to the threshold potential of the transistor Q11. The gate potential Vg can be retained by turning OFF the transistor Q12, so that the transistor Q11 is brought into such a state that the driving current Ids to flow therethrough. Then, the transistor Q13 is turned OFF, and an ON potential or an OFF potential is supplied to the gate terminal of the transistor Q14 via the transistor Q15. With this, the time-division gradation display is attained.

In the time-division gradation display carried out in this way, the set value of the current Ids flowing through the transistor Q11 is a maximum value of the current supplied to the organic EL element OLED. For example, when 4 gradation level is attained by a current Ids of 0.1 μA in a display apparatus for a 64 gradation display, a current Ids of 1.6 μA is required for acquirement of 64 gradation level.

Therefore, supposing that the source wire Sj has the same stray capacitance as that in the conventional technique, the period of setting the current flowing through the transistor Q11 is 1/16 as compared with the conventional technique in which a current value of 0.1 μA is set during one setting period.

As such, the present embodiment makes it possible to shorten time required for the setting of the output current of the transistor Q11, and allows driving of a larger number of gate wires. With this, a display is surely attained in the required number of pixels.

Embodiment 3

Next, Embodiment 3 is explained.

As is the case with Embodiment 2, an organic EL display apparatus 11 of the present embodiment includes a plurality of pixel circuits Aij (i=1 through m; j=1 through n), a source driver 2, a gate driver 3, a current driver 5, and a reference current source 6, as shown in FIG. 6.

Figure 11:
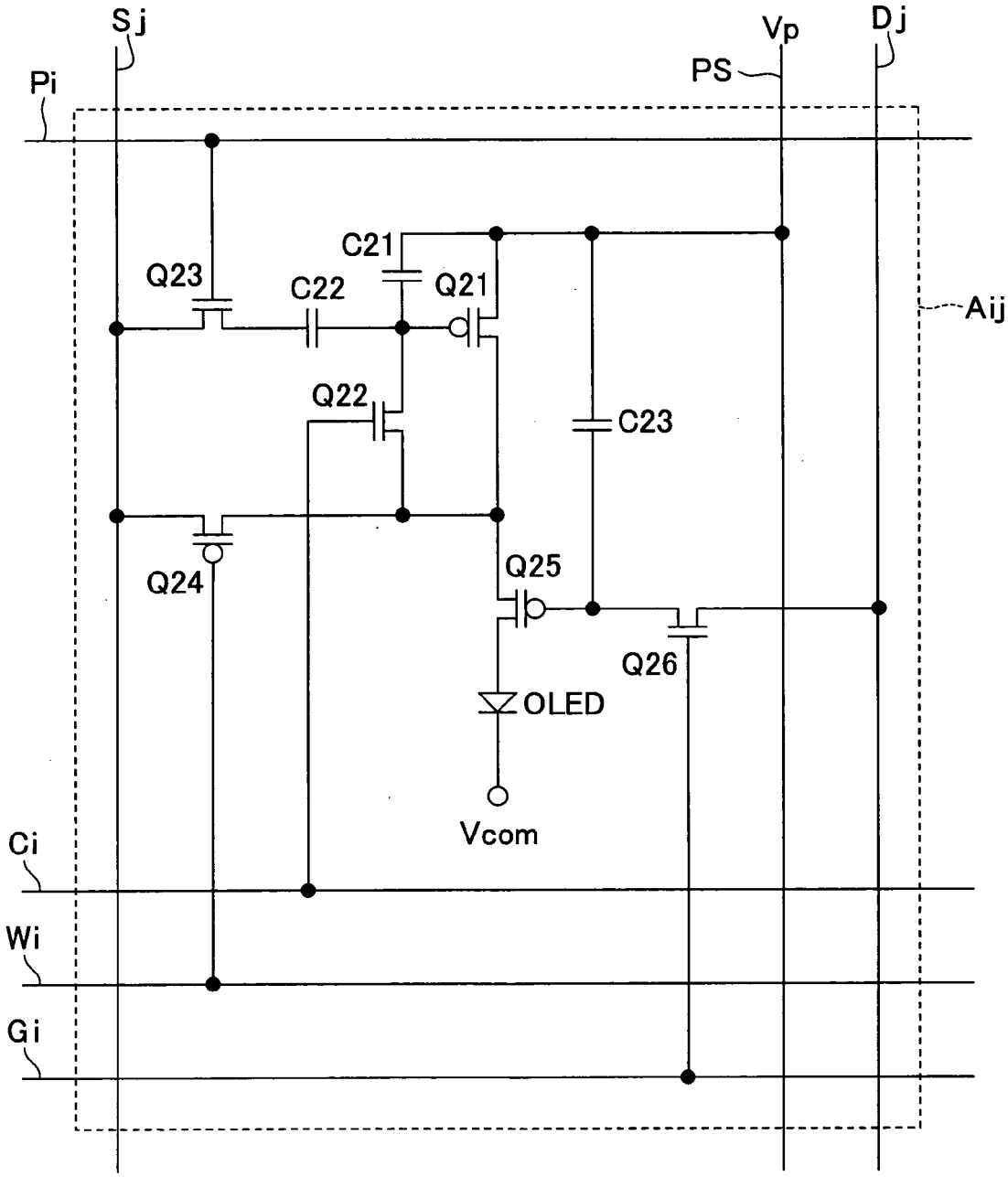
FIG. 11 is a block diagram illustrating a structure of a pixel circuit of an organic EL display apparatus of Embodiment 3 of the present invention.

FIG. 11 is a circuit diagram illustrating a structure of each of the pixel circuits Aij of the present invention.

As shown in FIG. 11, the pixel circuit Aij includes an organic EL element OLED, transistors Q21 through Q26, and capacitors C21 through C23. Each of the transistors Q21 through Q26 is a TFT made of polycrystalline silicon or CG silicon. The transistor Q21 (first transistor) and the transistor Q25 (second transistor) are driving transistors. The pixel circuit Aij has such a circuit structure that the transistor Q21, the transistor Q25, and the organic EL element OLED (display element) are provided in series between (i) a power supply wire PS for applying a power supply voltage Vp, and (ii) a common electrode for applying a common voltage Vcom.

The organic EL element OLED is provided in the vicinity of an intersection of a data wire Dj and a scan wire Gi. Provided as an anode of the organic EL element OLED is a pixel electrode made of ITO or the like. Whereas, provided as a cathode of the organic EL element OLED is the common electrode to which the common voltage Vcom is applied. The transistor Q22 (third transistor) is a switching transistor, and is provided between a gate terminal of the transistor Q21 and a drain terminal thereof. Further, the capacitor C21 is provided between the gate terminal of the transistor Q21 and a source terminal thereof. The transistor Q22 has a gate terminal connected to a control wire Ci. The transistor Q24 (fourth transistor) is provided between (i) a node of the transistors Q21 and Q25, and (ii) the source wire Sj. The transistor Q24 has a gate terminal connected to a control wire Wi.

The transistor Q26 is a switching transistor, and is provided between a gate terminal of the transistor Q25 and the data wire Dj. Further, the capacitor C23 is provided between a gate terminal of the transistor Q25 and the power supply wire PS. The gate terminal of the transistor Q21 is connected to one terminal of the capacitor C22. Between the other terminal of the capacitor C22 and the source wire Sj, the transistor Q23 (fifth transistor) is provided. The transistor Q23 has a gate terminal connected to a control wire Pi.

The capacitor C21 is a capacitor for retaining a gate potential for specifying an output current of the transistor Q21. The capacitor C23 is a capacitor for retaining a gate potential for turning the transistor Q25 ON or OFF. The capacitor C22 is a capacitor for retaining a potential difference between (i) a potential Va of the source wire Sj, and (ii) a gate potential Vp−|Vth| of the transistor Q21. The potential difference retained in the capacitor C22 allows the gate potential of the transistor Q21 to be a desired potential when the potential of the source wire Sj is changed from Va to Vx, irrespective of the variation in a threshold value of the transistor Q21.

Note that, in FIG. 11, the transistors Q22, Q23, and Q26 in the pixel circuit Aij are n-type TFTs, and the transistors Q21, Q24, and Q25 therein are p-type transistors. However, all the transistors Q21 through Q26 may be n-type transistor as long as control signals are appropriately supplied by (i) providing the transistor Q22 between the gate terminal of the transistor Q21, and the power supply wire PS; and (ii) providing the capacitor C21 between the gate terminal of the transistor Q21, and the drain terminal thereof.

Note also that the control wires Pi, Ci, and Wi are connected to the gate driver 3 shown in FIG. 6. The gate driver 3 also supplies, to the control wire Ci, a potential having a predetermined level. The power supply wire PS is connected to a DC power source circuit (not shown).

Figure 12:
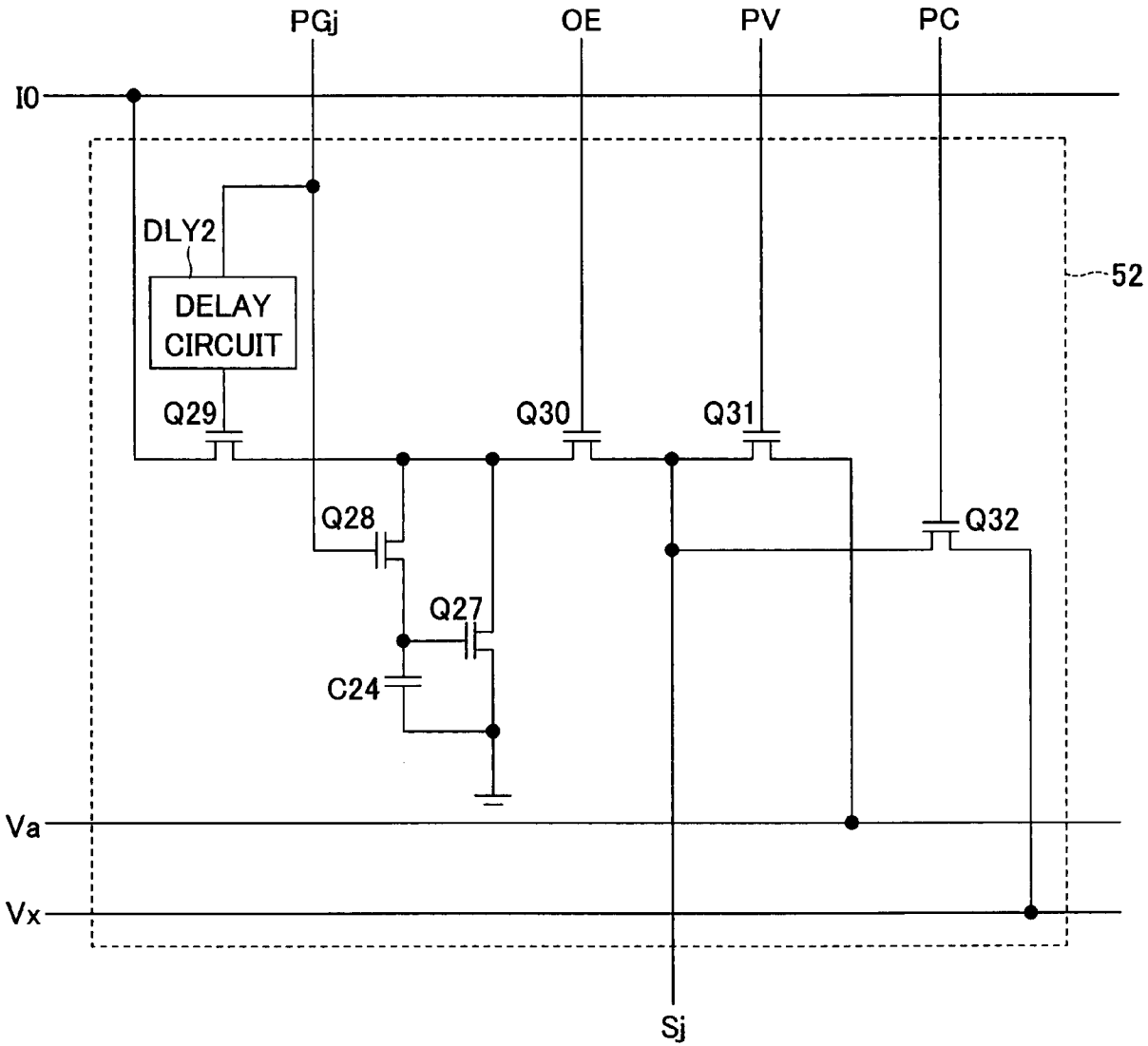
FIG. 12 is a circuit diagram illustrating a structure of a current driving circuit of the organic EL display apparatus of Embodiment 3 of the present invention.

FIG. 12 is a circuit diagram illustrating a structure of a current driving circuit 52 of the present embodiment.

As shown in FIG. 12, the current driving circuit 52 includes (i) transistors Q27 through Q32, each of which is a TFT; (ii) a capacitor C24, and (iii) a delay circuit DLY 2.

The delay circuit DLY2 has an input terminal for receiving a selection signal PGj sent from each output stage of a shift register 51. The delay circuit DLY2 outputs the received selection signal PGj with a delay of predetermined time. The delay circuit DLY2 has an output terminal connected to a gate terminal of the transistor Q29. Note that the selection signal PGj is also sent to a gate terminal of the switching transistor Q28.

The transistor Q29 has a drain terminal that receives a reference current I0, and has a source terminal that is connected to respective drain terminals of the transistors Q27, Q28, and Q30. The transistor Q28 has a source terminal connected to a gate terminal of the transistor Q27. The transistor Q27 has a source terminal connected to GND. The capacitor C24 is provided between the gate terminal of the transistor Q27 and the source terminal thereof. The transistor Q30 has a gate terminal that receives an output enabling signal OE sent from a control circuit 4, and has a source terminal connected to the source wire SJ.

Figure 13:
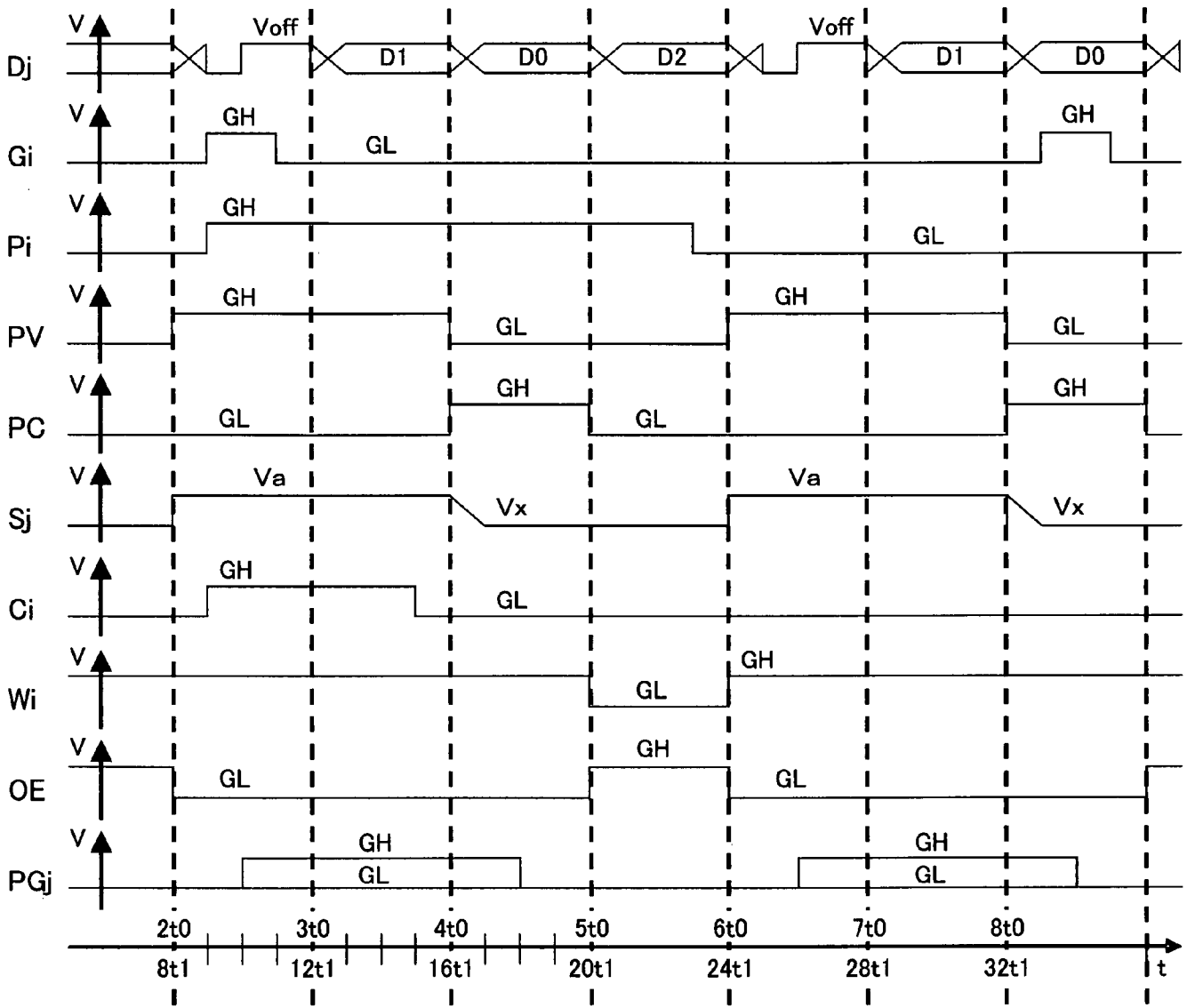
FIG. 13 is a timing chart illustrating an operation of setting an output current from a driving transistor of the pixel circuit shown in FIG. 11.

The output enabling signal OE is sent from the control circuit 4, and periodically becomes active ("High" level) as shown in FIG. 13. The delay circuit DLY2 is provided so that the transistor Q29 surely becomes OFF after the transistor Q28 becomes OFF. In cases where the transistor Q29 becomes OFF before the transistor Q28 becomes OFF, a current flowing through the transistor Q27 is changed from I0. This is not preferable.

The source terminal of the transistor Q30 is connected to respective drain terminals of the transistors Q31 and Q32. The transistor Q31 has a source terminal for receiving the voltage Va, and has a gate terminal for receiving a control signal PV. Further, the transistor Q32 has a source terminal for receiving the voltage Vx, and has a gate terminal for receiving a control signal PC.

Each of the control signals PV and PC is sent from the control circuit 4, and periodically becomes active ("High" level) as shown in FIG. 13.

In the present embodiment, during the threshold correction period of the transistor Q21, the potential Va is given to a terminal, associated with the transistor Q23, of the capacitor C22 such that the transistor Q21 becomes temporarily ON. Thereafter, the transistor Q25 is turned OFF (period of time from 10t1 to 16t1). This increases the gate potential of the transistor 21 to the threshold potential, with the result that the transistor Q21 is turned OFF. Then, the potential of the source wire Sj is set at Vx (Va>Vx). The setting causes the potential of the terminal of the capacitor C22 to be lower as compared with the potential thereof when the potential Va is supplied to the terminal. Accordingly, the potential of the transistor Q21 is decreased, with the result that the transistor Q21 becomes ON (the transistor Q21 is a p-type transistor in this case).

The following explains an operation of setting an output current from the transistor Q21 in the pixel circuit Aij structured as above. The setting operation is carried out by the source driver 2 and the gate driver 3 under control of the control circuit 4. FIG. 13 is a timing chart illustrating the operation of setting the output current of the transistor Q21.

Firstly carried out for the setting of the value of the output current of the driving transistor Q21 are: (i) turning OFF of the transistor Q30 and Q32 by setting the output enabling signal OE and the control signal PC at "Low" (time 8t1 in FIG. 13); and (ii) turning ON of the transistor Q31 by setting the control signal PV at "High". On this account, the voltage Va is supplied to the source wire Sj. Further, respective potential levels of the control wire Pi and the control wire Ci are set at "High", so that the transistors Q23 and Q22 are turned ON (time 9t1 in FIG. 13).

Further, the potential level of the scan wire Gi is set at High such that the transistor Q26 becomes ON (time 9t1 in FIG. 13). This allows momentary application of an ON potential to the transistor Q25. At the moment of the application, the gate of the transistor Q21 and the drain thereof are short-circuited via the transistor Q22, with the result that the transistor Q21 becomes ON.

Next, an OFF potential is supplied from the data wire Dj to the transistor Q25 (period of time from 10t1 to 11t1 in FIG. 13) so as to turn OFF the transistor Q25. On this occasion, the voltage Va is supplied from the source wire Sj to the terminal of the capacitor C22, which terminal is toward the transistor Q23.

Moreover, because the gate of the transistor Q21 and the drain thereof are short-circuited via the transistor Q22, the gate potential of the transistor Q21 increases. Specifically, the potential of the gate terminal of the transistor Q21 is changed from an ON potential to an OFF potential. With this, a source-gate potential of the transistor Q21 is regarded as a threshold potential. The source-gate potential on this occasion is maintained (time 15t1 in FIG. 13) by turning OFF the transistor Q22 by setting the potential level of the control signal at "Low".

Next, the logical level of the control wire Wi is set at "Low" so that the transistor Q24 becomes ON, and a current accordingly flows from the transistor Q21 to the source wire Sj. On this occasion, in the current driving circuit 52 shown in FIG. 12, the control signal PV is set at "Low" such that the transistor Q31 becomes OFF, and the control signal PC is set at "High" such that the transistor Q32 becomes ON, and the output enabling signal OE is maintained at "Low" such that the transistor Q30 is kept being OFF (time 16t1 in FIG. 13). With this, the potential of the source wire Sj is changed to the potential Vx.

For the supply of the reference current I0 via the transistor Q21, an approximate target potential for the gate of the transistor Q21 can be found in advance by subtracting an appropriate value from the threshold potential. Therefore, when the potential of the terminal (toward the source wire Sj) of the capacitor C22 is changed from Va to Vx set at such an appropriate target potential, it is estimated that the transistor Q21 allows the reference current I0 to flow therethrough.

So, thereafter, the control wire PC is set at "Low" such that the transistor Q32 becomes OFF, and the output enabling signal OE is set at "High" so as to turn ON the transistor Q30 (while the transistor Q31 is OFF). With this, the source wire Sj is connected to the source terminal of the transistor Q27 (time 20t1 in FIG. 13). As described in Embodiment 2, the transistor Q27 is in such a state that the reference current I0 flows therethrough. Accordingly, the reference current I0 flows from the transistor Q21 to the transistor Q27 via the source wire Sj.

The variation in the mobility of the transistor Q21 possibly causes the gate potential to be greatly changed from the target value on this occasion; however, time for the change is shorter than that in the structure in Embodiment 2 in which the target potential Vx cannot be applied in advance. Moreover, the gate potential of the transistor Q21 on this occasion is maintained by turning OFF the transistor Q23 (time 23t1 in FIG. 13), and the transistor Q24 is turned OFF (time 24t1 in FIG. 13), with the result that the output current of the transistor Q21 is determined.

Note that the transistor Q27 of the current driving circuit 52 sequentially outputs a current in accordance with the reference current I0, while the transistor Q30 is OFF.

As such, irrespective of the threshold voltage of the transistor Q21, the gate potential of the transistor Q21 is regarded as the threshold potential by supplying, for the purpose of correcting the threshold voltage of the transistor Q21, the potential Va to the terminal of the capacitor C22 via the source wire Sj.

In this way, in the present embodiment, the predetermined voltage Va is supplied to the other terminal of the capacitor C22 for the sake of the threshold voltage correction of the transistor Q21. Then, the potential of the terminal of the capacitor C22 is changed by the potential supplied via the source wire Sj. With this, the output current of the transistor Q21 can be determined irrespective of the threshold voltage of the transistor Q21. Further, such a desired current flows from the transistor Q21 to the transistor Q27 of the current driving circuit 52, so that the variation of the output current due to the mobility of the transistor Q21 can be corrected.

By thus changing the potential of the source wire Sj with the use of the transistor Q32 connected to the voltage source for supplying the potential Vx, the stray capacitance of the source wire Sj can be charged in a short period of time.

Accordingly, the use of the current setting method allows the output current of the transistor Q21 to be set in a shorter period of time.

Embodiment 4

Next, Embodiment 4 is explained.

Figure 14:
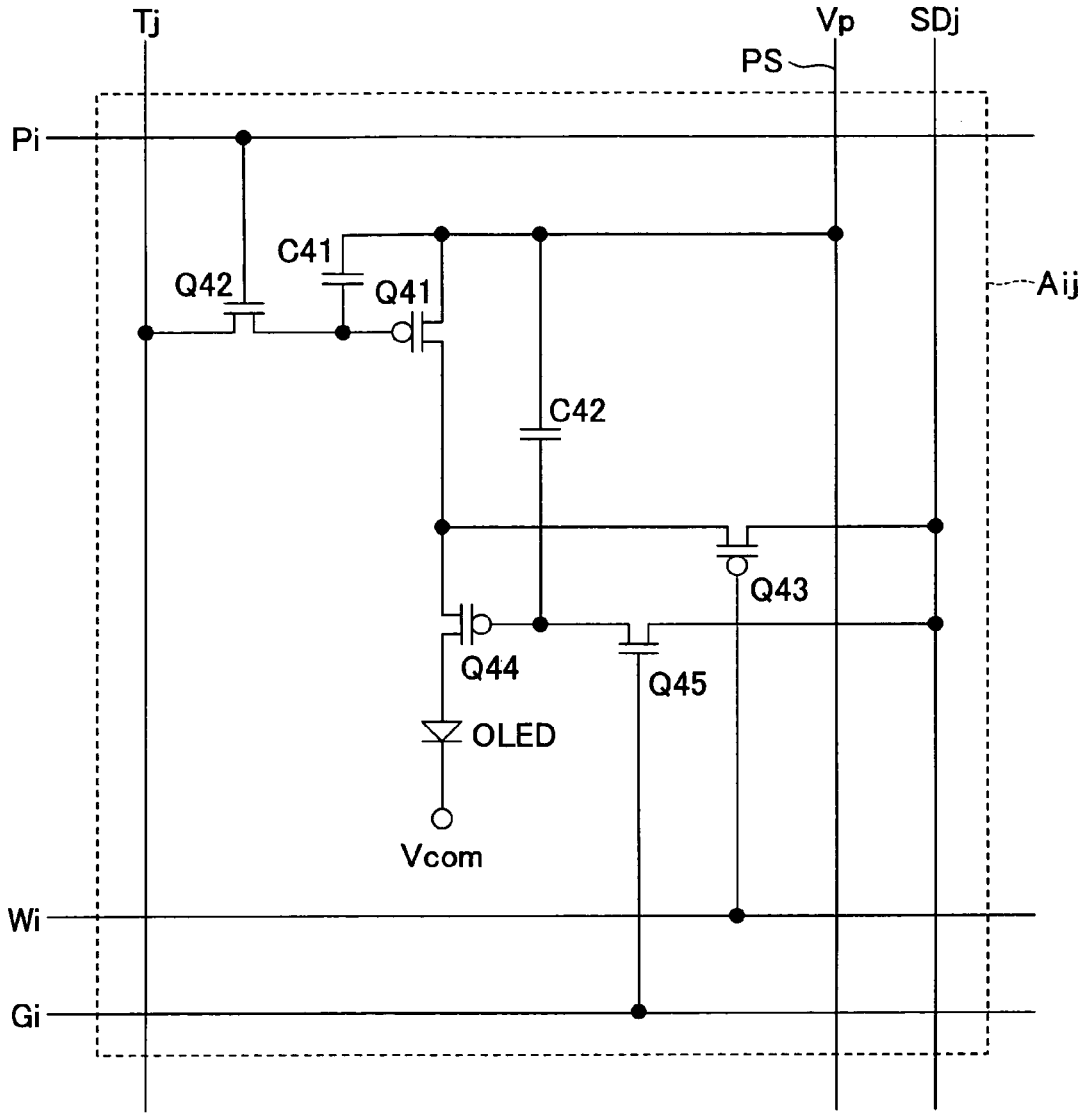
FIG. 14 is a circuit diagram illustrating a structure of a pixel circuit in an organic EL display apparatus of Embodiment 4 of the present invention.

A display apparatus of the present embodiment is similar to the organic EL display apparatus 11 (see FIG. 6) described above, but has such a pixel circuit Aij as shown in FIG. 14.

As shown in FIG. 14, the pixel circuit Aij includes an organic EL element OLED, transistors Q41 through Q45, and capacitors C41 and C42. Each of the transistors Q41 through Q45 is a TFT made of polycrystalline silicon or CG silicon, and the transistor Q41 (first transistor) and the transistor Q44 (second transistor) are driving transistors. The pixel circuit Aij has such a circuit structure that the transistor Q41, the transistor Q44, and the organic EL element OLED (display element) are provided in series between (i) a power supply wire PS for applying a power voltage Vp, and (ii) a common electrode for applying a common voltage Vcom.

The organic EL element OLED is provided in the vicinity of an intersection point of a scan wire Gi and a common wire SDj that serves as a source wire in a certain period of time and that serves as a data wire in the other period of time. Provided as an anode of the organic EL element OLED is a pixel electrode made of ITO or the like. Whereas, provided as a cathode of the organic EL element OLED is the common electrode to which the common voltage Vcom is applied. The capacitor C41 is provided between (i) the gate terminal of the transistor Q41 and (ii) the source terminal thereof. Further, the transistor Q43 (fourth transistor), serving as a switching transistor, is provided between (i) a node of the transistors Q41 and Q44, (ii) and the common wire SDj. The transistor Q43 has a gate terminal connected to the control wire Wi.

The transistor Q45 serves as a switching transistor, and is provided between the gate terminal of the transistor Q44 and the common wire SDj. Further, the capacitor C42 is provided between the gate terminal of the transistor Q45 and the power supply wire PS. The transistor Q42 is provided between the gate terminal of the transistor Q41 and a wire Tj. The transistor Q42 has a gate terminal connected to a control wire Pi.

Note that, in FIG. 14, the transistors Q42 and Q45 of the pixel circuit Aij are n-type TFTs, and the transistors Q41, Q43, and Q44 thereof are p-type TFTs.

Figure 15:
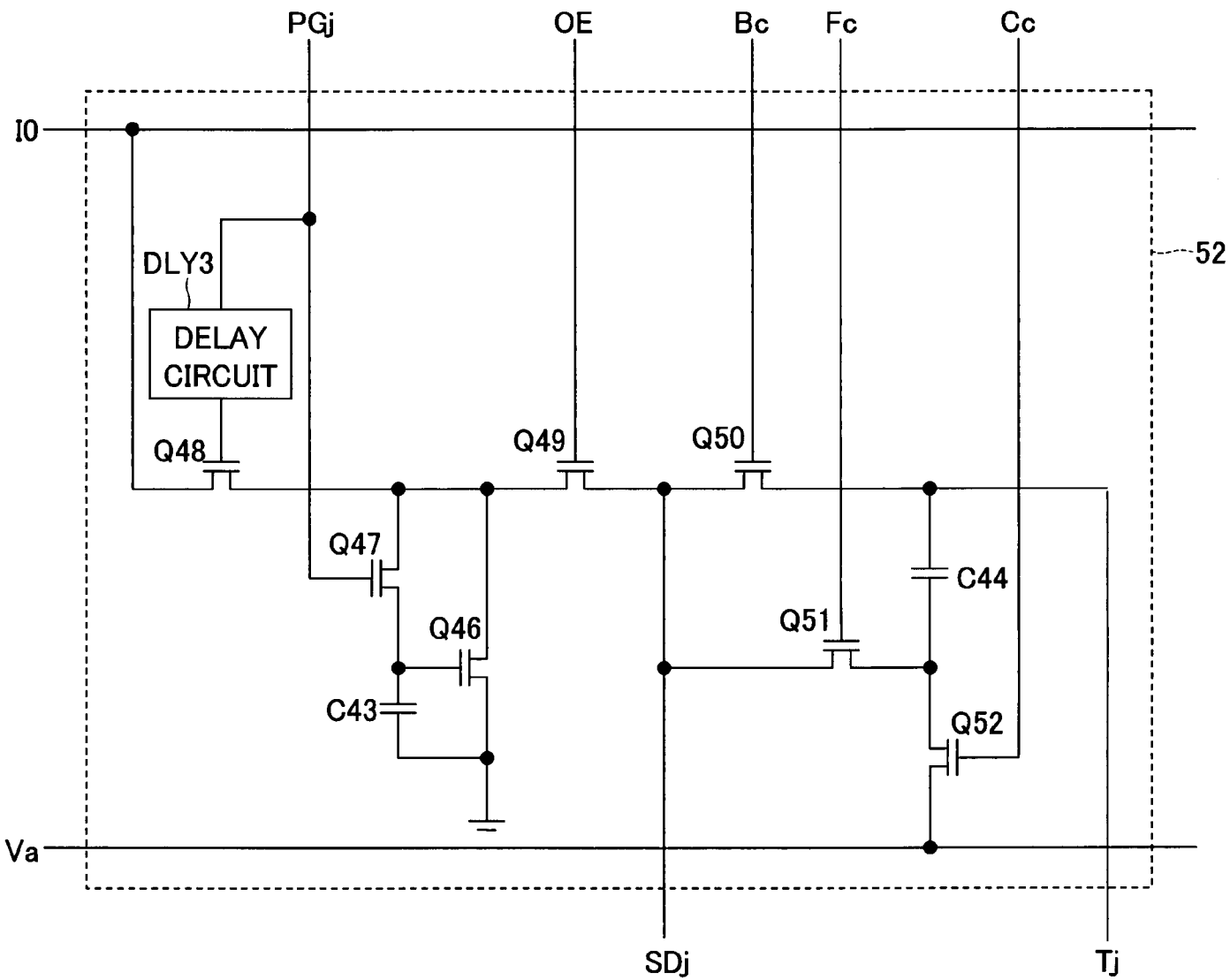
FIG. 15 is a circuit diagram illustrating a structure of a current driving circuit of the organic EL display apparatus of Embodiment 4 of the present invention.

FIG. 15 is a circuit diagram illustrating a structure of the current driving circuit 52 of the present embodiment.

As shown in FIG. 15, the current driving circuit 52 includes (i) transistors Q46 through Q52, each of which is a TFT; (ii) capacitors C43 and C44; and (iii) a delay circuit DLY3.

The delay circuit DLY3 has an input terminal for receiving a selection signal PGj sent from each output stage of a shift register 51. The delay circuit DLY3 outputs the received selection signal PGj with a delay of a predetermined time. The delay circuit DLY3 has an output terminal connected to a gate terminal of the transistor Q48. The selection signal PGj is also sent to a gate terminal of the switching transistor Q47.

The transistor Q48 has a drain terminal for receiving a reference current I0 supplied from the reference current source 6, and has a source terminal that is connected to respective drain terminals of the transistors Q46, Q47, and Q49. The transistor Q47 has a source terminal connected to the gate terminal of the transistor Q46. The transistor Q46 has a source terminal connected to GND. The capacitor C43 is provided between the gate terminal of the transistor Q46 and the source terminal thereof. The transistor Q49 has a gate terminal for receiving an output enabling signal OE supplied from a control circuit 4, and has a source terminal connected to the common wire SDj.

The transistor Q49 has a source terminal connected to respective drain terminals of the transistor Q50 and Q51. The transistor Q50 has a gate terminal for receiving a control signal Bc, whereas the transistor Q51 has a gate terminal for receiving a control signal Fc. Between respective source terminals of the transistors Q50 and Q51, the capacitor C44 is provided. Further, the source terminal of the transistor Q51 is connected to a drain terminal of the transistor Q52. The transistor Q52 has a gate terminal that receives a control signal Cc, and has a source terminal to which a voltage Va is applied. Further, the source terminal of the transistor Q50 is connected to the wire Tj.

The controls signals Bc, Fc, and Cc are sent from the control circuit 4.

Figure 16:
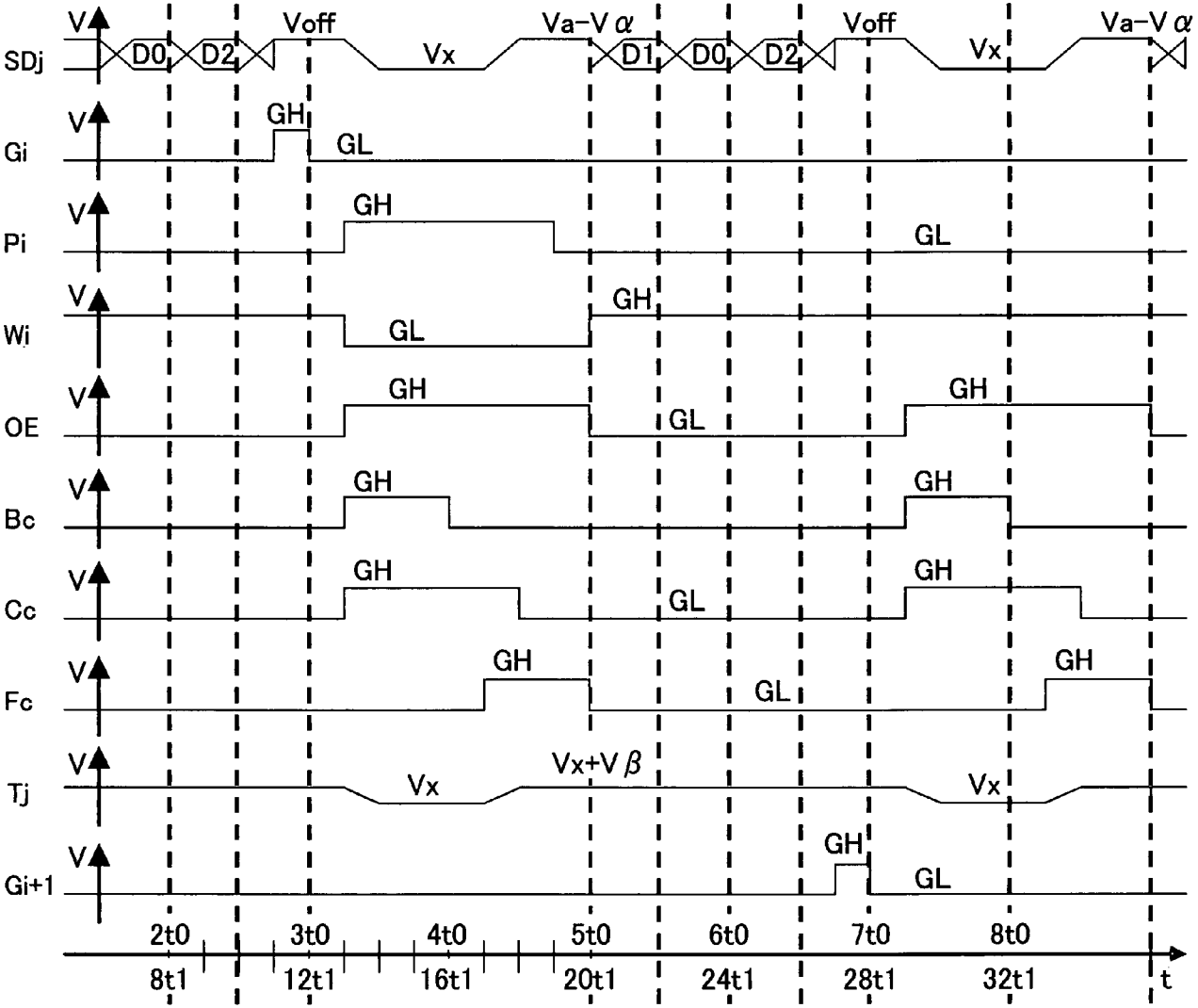
FIG. 16 is a timing chart illustrating an operation of setting an output current from a driving transistor of the pixel circuit shown in FIG. 14.

The following explains an operation of setting the output current from the transistor Q41 of the pixel circuit Aij structured as above. The setting operation is carried out by a source driver 2 and a gate driver 3 under control of the control circuit 4. FIG. 16 is a timing chart illustrating the operation of setting the output current from the transistor Q41.

Also in the pixel circuit Aij of the present embodiment, a value of the output current of the transistor Q41 is set by using the current program method. However, the pixel circuit Aij shown in FIG. 14 sets a gate potential of the transistor Q41 while keeping a source-drain potential of the transistor Q41 at a constant value. A reason for this is as follows. That is, a value of the current flowing through the transistor Q41 is slightly changed due to a change in the source-drain potential of the transistor Q41. To accommodate this, the value of the current flowing through the transistor Q41 is determined by so setting the drain potential of the transistor Q41 as to match with an estimated anode potential of the organic EL element OLED.

Firstly, a logical level of the scan wire Gi in the pixel circuit Aij is set at "High" so that the transistor Q45 becomes ON (time 11t1 in FIG. 16). With this, an OFF potential is supplied from the common wire SDj to the gate terminal of the transistor Q44. Thereafter, the logical level of the scan wire Gi is set at "Low" so that the transistor Q45 becomes OFF (time 12t1 in FIG. 16). Now, the transistor Q45 is OFF and the transistor Q44 is OFF.

Next, in the current driving circuit 52, the output enabling signal OE, and the control signals Bc and Cc are set at "High" so that the transistors Q49, Q50, and Q52 become ON (time 13t1 in FIG. 16), respectively. On the other hand, in the pixel circuit Aij, a logical level of the control wire Pi is set at "High" so that the transistor Q42 becomes ON, and a logical level of the control wire Wi is set at "Low" so that the transistor Q43 becomes ON (time 13t1 in FIG. 16). With this, the reference current I0 flows from the transistor Q41 to the current driving circuit 52 via the transistor Q43.

Note that, in the present embodiment, the transistor Q43, the common wire SDj, the transistor Q50, the wire Ti, the transistor Q42 replace the third transistor that should be provided between (i) the gate terminal of the transistor Q41 and (ii) the node of the transistor Q41 and the transistor Q44.

The transistor Q46 of the current driving circuit 52 specifies, at a current value I0, the reference current I0 thus flowing from the transistor Q41. The reference current I0 from the transistor Q41 flows in this way when a potential of a terminal, facing the transistor Q52, of the capacitor C44 corresponds to the power supply voltage Va. (Note that, on this occasion, the transistor Q41 has a drain potential of Vp−|Vth|.)

Next, in the current driving circuit 52, the control signal Bc is set at "Low" such that the transistor Q50 becomes OFF (time 16t1 in FIG. 16). This disconnects the connection between the common wire SDj and the wire Tj. Thereafter, the control signal Fc is set at "High" such that the transistor Q51 becomes ON (17t1 in FIG. 16). This connects the common wire SDj to the wire Ti via the capacitor C44.

On this occasion, the power supply voltage Va is applied to the common wire SDj via the transistors Q51 and Q52, with the result that the potential of the common wire SDj becomes the power supply voltage Va. Meanwhile, the gate potential of the transistor Q41 is unchanged because the transistor Q50 is OFF and the terminal, facing the transistor Q52, of the capacitor C44 has a potential corresponding to the power supply voltage Va.

Next, the control signal Cc is set at "Low" such that the transistor Q52 becomes OFF (time 18t1 in FIG. 16). With this, the reference current I0 flows again from the transistor Q41 to the current driving circuit 52 via the common wire SDj.

On this occasion, the gate potential of the transistor Q41 is in such a level that the reference current I0 flows therethrough, in cases where the drain potential of the transistor Q41 is Vp−|Vth|. However, the drain potential of the transistor Q41 is changed to the power supply potential Va. The change affects the gate potential of the transistor Q41 through the capacitor C44. This slightly changes the gate potential of the transistor Q41; however, the transistor Q41 still allows the reference current I0 to flow therethrough.

With this, the gate-source potential Vgs can be determined such that the value of the current flowing through the transistor Q41 is I0 when the source-drain potential of the transistor Q41 is substantially Vp−Va.

Thereafter, the logical level of the control wire Pi is set at "Low" so that the transistor Q42 becomes OFF (time 19t1 in FIG. 16). On this account, the transistor Q41 maintains the gate potential and still allows the reference current I0 to flow therethrough.

Although the wire Ti is further provided in the present embodiment as above, the use of the common wires SDj allows reduction of the number of wires as compared with the structure in which the data wires Dj and the source wires Sj are individually provided. Moreover, the current flowing through the transistor Q41 can be set by beforehand setting the drain voltage of the transistor Q41 at a voltage as large as a voltage that is to be fed to the organic EL element OLED. This reduces an error in setting the current, and accordingly improves display quality. Further, the number of required wires is the same as the number of required wires in the pixel circuit Aij shown in FIG. 7, so that cost of the organic EL display apparatus 11 can be reduced.

Note that the pixel circuit Aij shown in FIG. 14 uses the common wire SDj for the setting of the output current of the transistor Q41. This shortens a period during which the common wire SDj is used for the setting of the state of the transistor Q44.

To accommodate this, time required for writing a voltage in the transistor Q44 is shortened such that the setting of a voltage in the transistor Q44 can be carried out four times during the period (from 4×n×t0+t0, to 4×n×t0+3t0 in FIG. 16) during which the common wire SDj is not used for the setting of the output current of the transistor Q41, as shown in FIG. 16.

Figure 17:
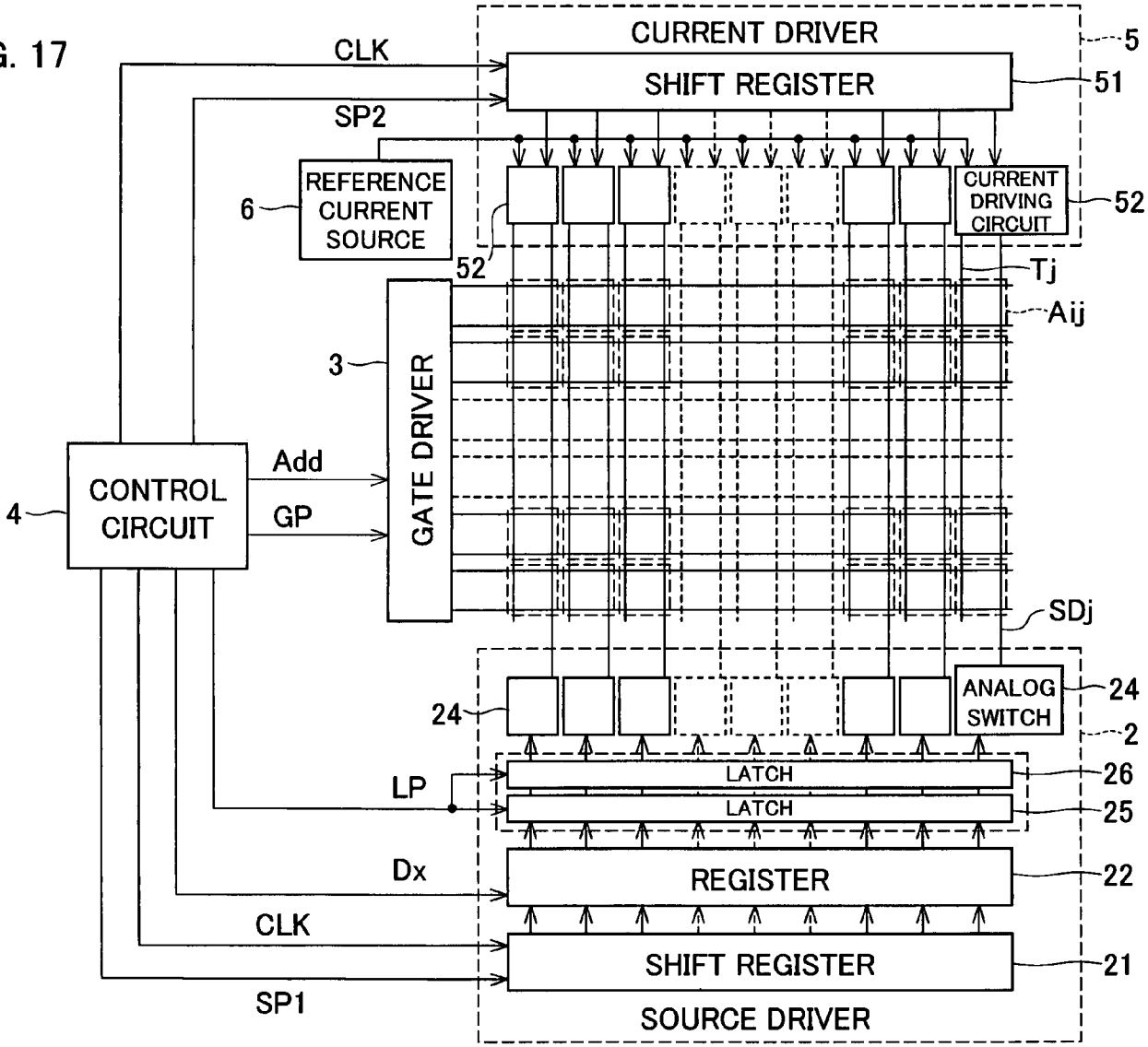
FIG. 17 is a block diagram illustrating a structure of a modified example of the organic EL display apparatus of Embodiment 2 of the present invention.

Meanwhile, an increase in a frequency of the digital image data Dx sent from outside of the organic EL display apparatus 11 is not preferable. Therefore, timing for sending the digital image data Dx to the common wire SDj is appropriately determined such that the output of the digital image data Dx is carried out during a period of time from, for example, 20t1 to 26t1 when a data transfer time is constant. For this setting, a plurality of latches 25 and 26 are provided between a register 22 and each analog switch 24 as shown in FIG. 17.

Figure 18:
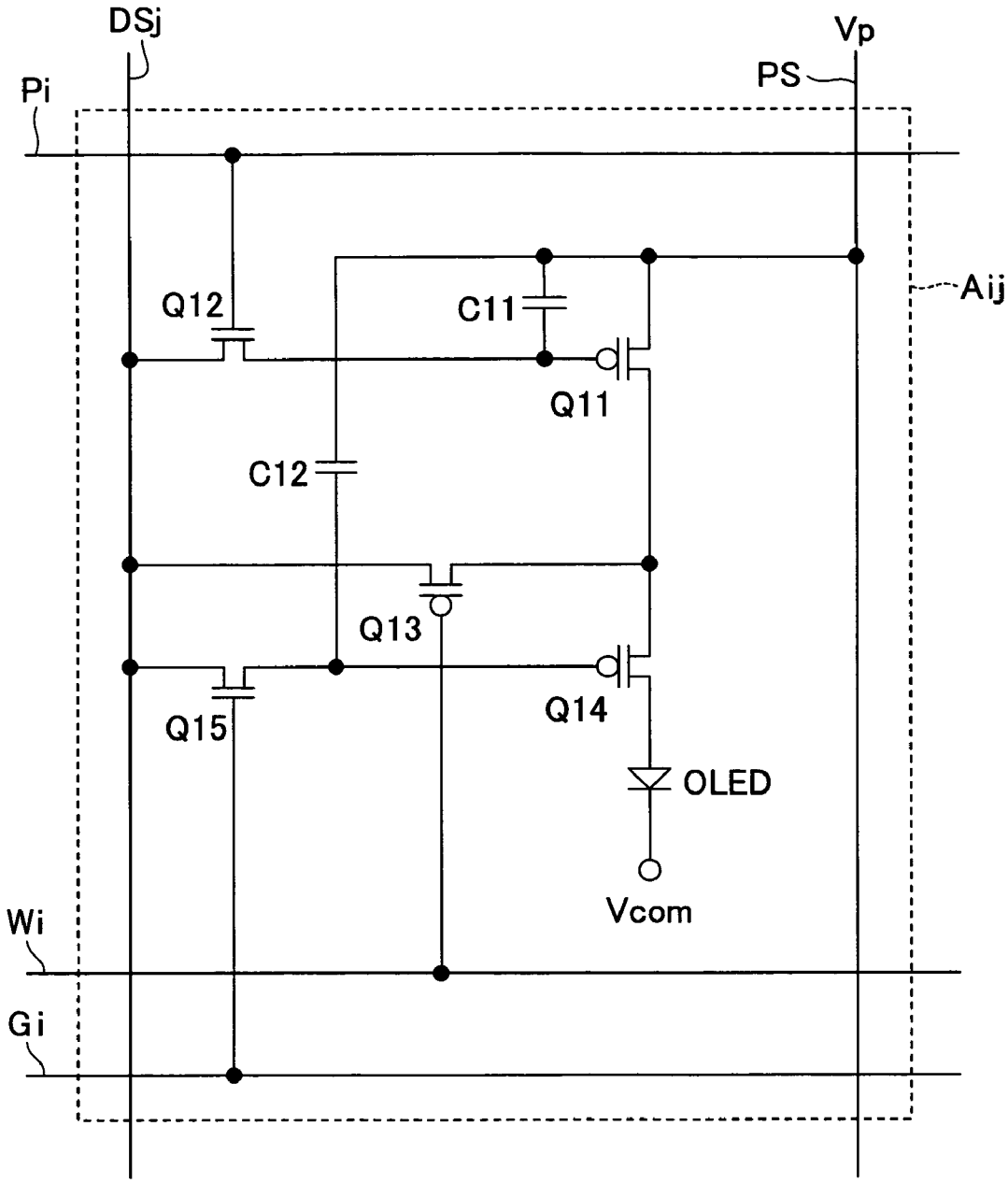
FIG. 18 is a circuit diagram illustrating a structure of a pixel circuit of the modified example.

In cases where the latches 25 and 26 are provided so as to adjust, according to the data transfer time, the time of sending the data to the common wire SDj, the pixel circuit Aij can be modified to a pixel circuit Aij shown in FIG. 18.

Embodiment 5

Next, Embodiment 5 is explained.

Figure 19:
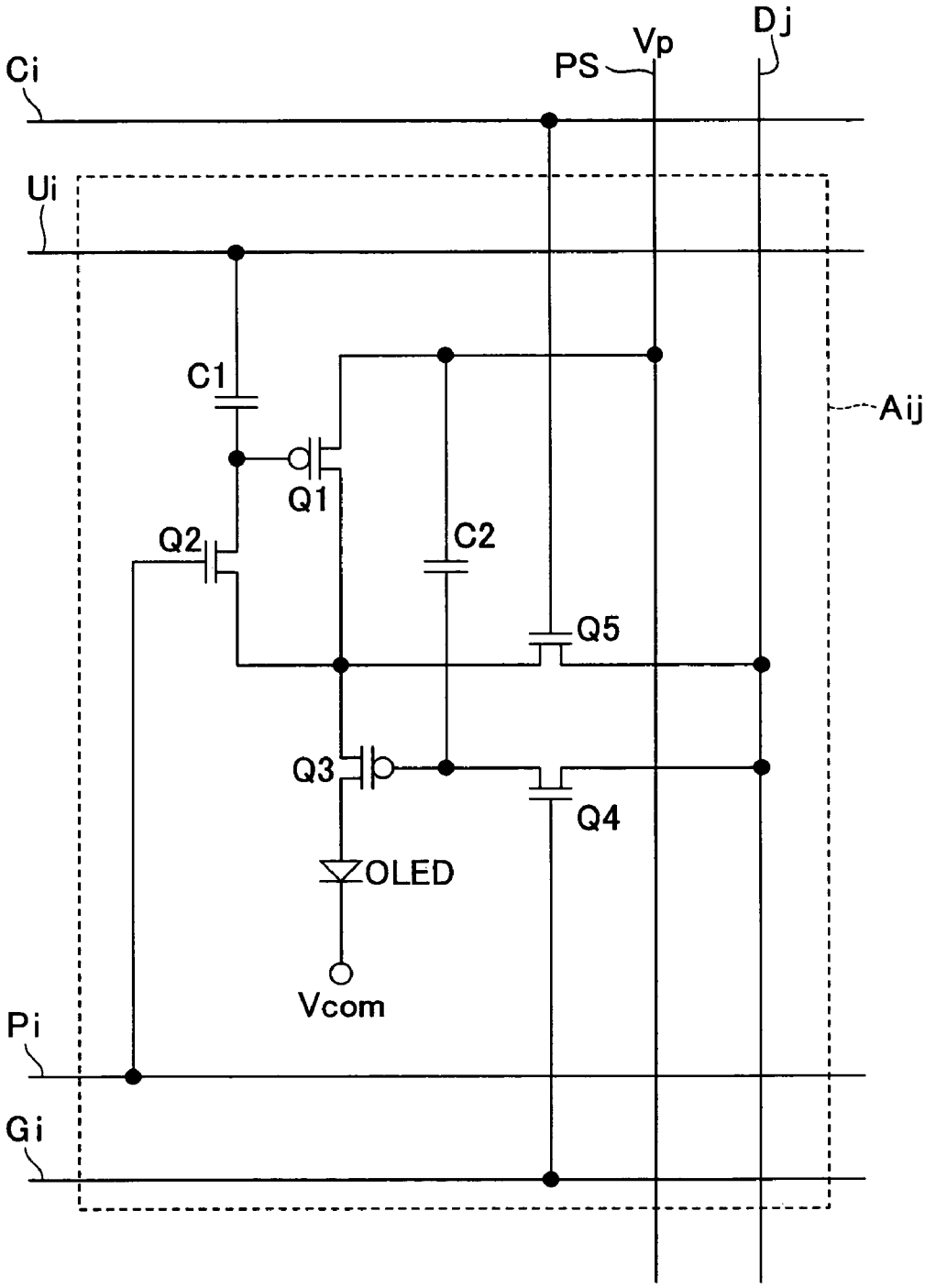
FIG. 19 is a circuit diagram illustrating a structure of a pixel circuit of an organic EL display apparatus of Embodiment 5 of the present invention.
Figure 20:
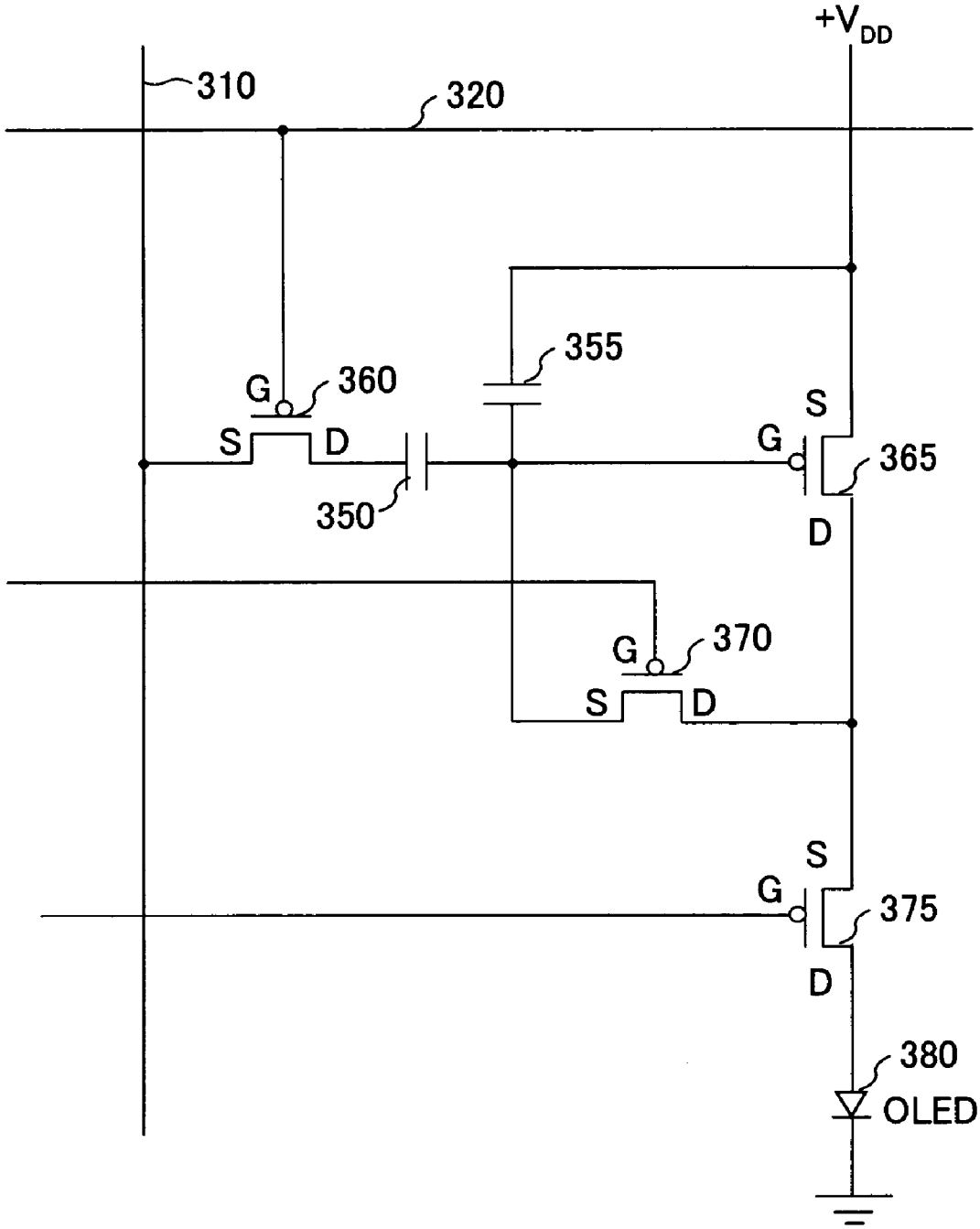
FIG. 20 RELATED ART
FIG. 20 is a circuit diagram illustrating a structure of a pixel circuit in a conventional organic EL display apparatus.
Figure 21:
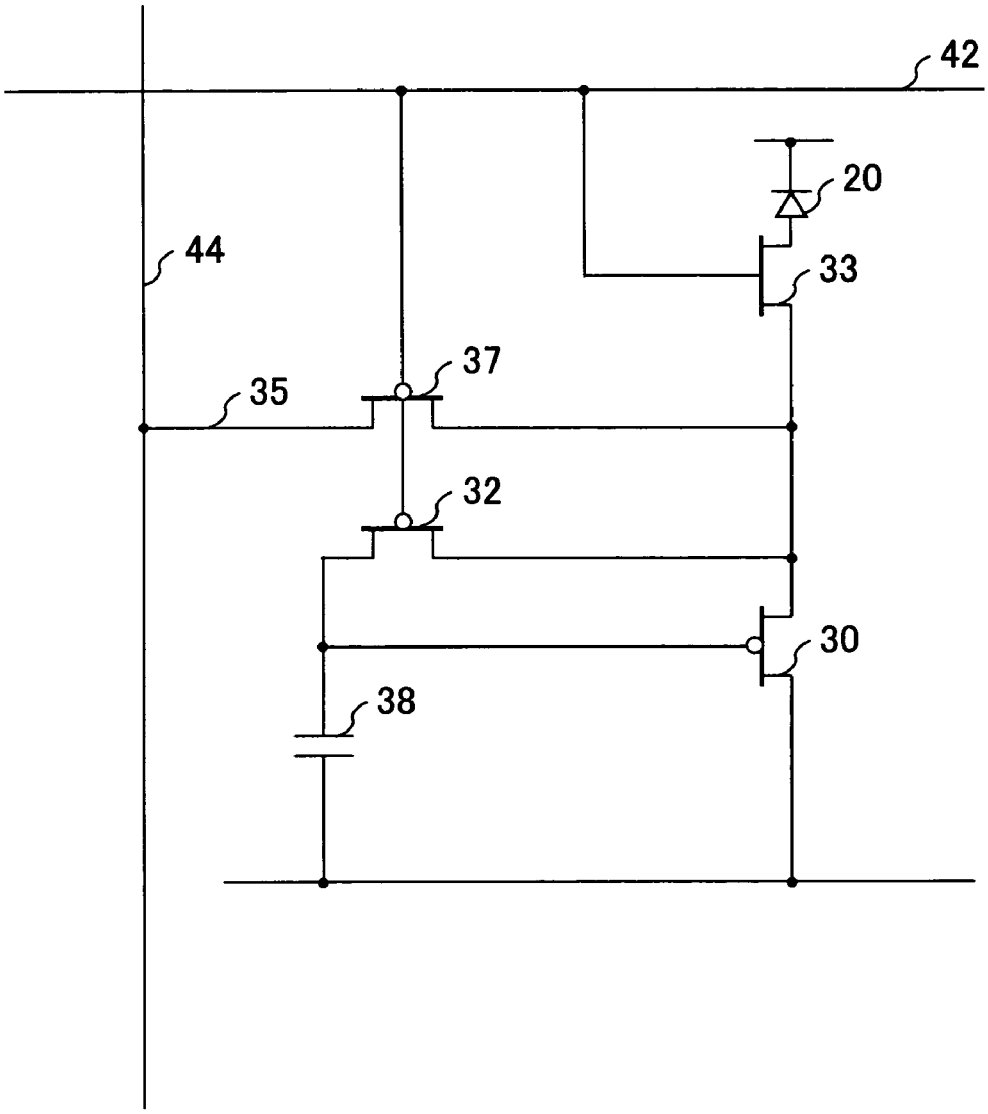
FIG. 21 RELATED ART
FIG. 21 is a circuit diagram illustrating a structure of a pixel circuit in another conventional organic EL display apparatus.

The present embodiment is structured in a similar manner to the organic EL display apparatus 1 shown in FIG. 2; however, the present embodiment has a pixel circuit Aij structured as shown in FIG. 19.

The pixel circuit Aij shown in FIG. 19 further includes a transistor Q5 in addition to the pixel circuit Aij shown in FIG. 1. The transistor Q5 is an n-type TFT, and is provided between the drain terminal of the transistor Q1 and the data wire Dj. The transistor Q5 has a gate terminal connected to a potential wire Ci.

Such a pixel circuit Aij enables that no current flow to the organic EL element OLED by way of operations of the source driver 2 and the gate driver 3 which are under control of the control circuit 4, when programming (setting) a value of an output current of the transistor Q1. Specifically, the transistor Q3 is turned OFF in advance, and the transistor Q2 is turned ON, and the transistor Q5 is turned ON for a moment. With this, a low potential, which may be an ON potential, is supplied to the data wire Dj.

This causes turning ON of the transistor Q1, and then the threshold voltage correction of the transistor Q1 is carried out.

In the pixel circuit Aij shown in FIG. 1, while the scan wire Gi is High (period of time from 9t1 to 11t1), the data wire Dj is set at Low for a moment (period of time from 9t1 to 10t1) so that the transistor Q3 becomes ON. During this period, the output current programming is carried out, so that a current flows into the organic EL element OLED. The current flowing into the organic EL element OLED on this occasion causes light-emitting, so that a luminance never becomes 0 even in the darkest display (gradation 0) (a contrast in a dark room has a finite value).

On the other hand, in the pixel circuit Aij shown in FIG. 19, even in cases where the data wire Dj is set at High while the scan wire Gi is High, i.e., during the period of time from 9t1 to 11t1, no current flows into the organic EL element OLED. What makes this possible is to turn ON the transistor Q1 by turning ON the transistor Q5 after the setting of the data wire Dj. With this, the light-emitting never occurs in the darkest state (gradation 0) (a contrast in a dark room can be infinite).

As such, no current flows into the organic EL element OLED in the pixel circuit Aij shown in FIG. 19 upon the turning ON of the transistor Q1, unlike the structure of the pixel circuit Aij shown in FIG. 1. This allows a high contrast.

Note that the aforesaid embodiments explain the structure using the organic EL element as the current driving type display element. However, the present invention is not limited to these, and is applicable to a display apparatus using another current driving type display element, such as an FED.

Embodiment 6

Next, Embodiment 6 is explained.

Figure 26:
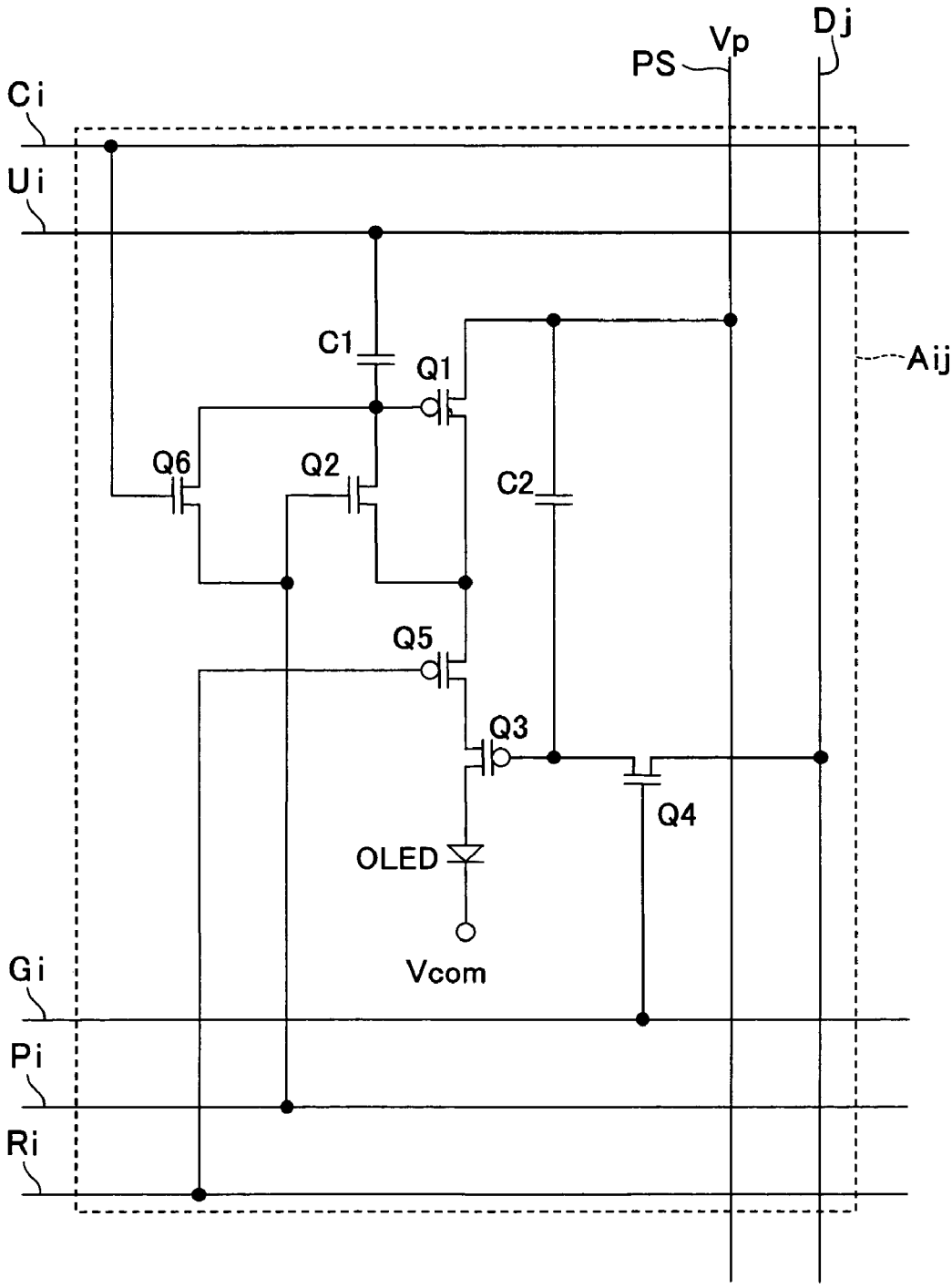
FIG. 26 is a circuit diagram illustrating a structure of a pixel circuit of the organic EL display apparatus of Embodiment 6 of the present invention.

The present embodiment is structured in a similar manner to the organic EL display apparatus 1 shown in FIG. 2; however, the present embodiment has a different pixel circuit Aij structured as shown in FIG. 26.

The pixel circuit Aij shown in FIG. 26 further includes transistors Q5 and Q6 in addition to the pixel circuit Aij shown in FIG. 1.

The transistor Q5 (third transistor) is a p-type switching TFT, and is provided between the driving transistor Q1 (first transistor) and the driving transistor Q3 (second transistor). The transistor Q6 is an n-type switching TFT, and is provided between the gate terminal of the driving transistor Q1 and the gate terminal of the switching transistor Q2 (third transistor). The transistor Q5 has a gate terminal connected to a control wire Ri, and the transistor Q6 has a gate terminal connected to the control wire Ci.

Note that the transistor Q5 may be provided between the transistor Q3 and the organic EL element OLED.

The pixel circuit Aij thus structured makes it possible that, by setting the potential of the control wire Ri at High, no current flows from the transistor Q1 to the organic EL element OLED irrespective of the operation state (ON state or OFF state) of the transistor Q3. Moreover, the transistor Q1 can be turned ON by applying a voltage to the gate terminal of the transistor Q1 by setting the potential of the control wire Ci at High while the potential of the control wire Pi is Low.

Figure 27:
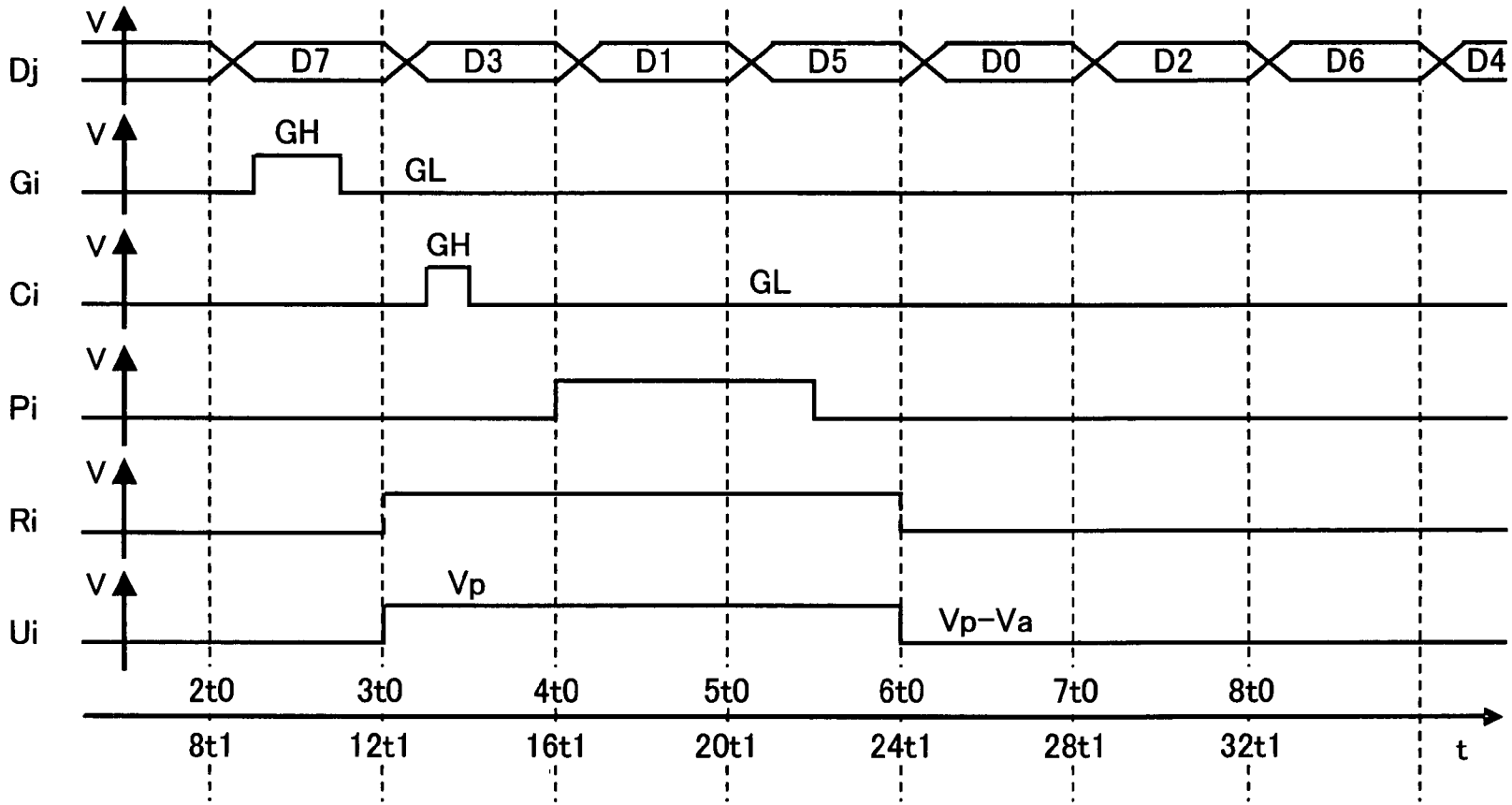
FIG. 27 is a timing chart illustrating an operation of setting an output current from a driving transistor of the pixel circuit shown in FIG. 26.

Here, FIG. 27 illustrates timings when programming (setting) the value of the output current of the transistor Q1.

In the pixel circuit Aij shown in FIG. 26, the potential of the potential wire Ui is set at Vp (period of time from 12t1 to 24t1), and the potential of the control wire Ri is set at High (period of time from 12t to 24t1), and the potential of the control wire Ci is set at High for a moment (period of time from 13t1 to 14t1), thereby turning ON the transistor Q6. This connects the gate terminal of the transistor Q1 to the control wire Pi, so that the transistor Q1 becomes ON.

Next, the potential of the control wire Pi is set at High (period of time from 16t1 to 22t1) such that the transistor Q2 becomes ON. With this, the current flows from the source terminal of the transistor Q1 to the gate terminal of the transistor Q1. When the current causes the gate terminal voltage to be Vp−|Vth|(Vth<0), the transistor Q1 becomes OFF.

A potential difference between the potential wire Ui and the gate terminal of the transistor Q1 is retained in the capacitor C1, by so setting the potential of the control wire Pi at Low that the transistor Q2 becomes OFF (time 22t1). Then, the potential of the potential wire Ui is changed from Vp to Vp−Va, and the potential of the control wire Ri is set at Low (time 24t1). This makes it possible that the current flowing through the transistor Q1 becomes constant irrespective of the threshold voltage Vth of the transistor Q1.

As such, the pixel circuit of the present embodiment is arranged so that the value of the output current of the transistor Q1 is set during the OFF period of the transistor Q5 provided in series with the transistor Q3. With this, no current flows into the organic EL element OLED upon the turning ON of the transistor Q1, unlike the structure of the pixel circuit shown in FIG. 1. This allows a high contrast. Moreover, the OFF period of the transistor 5 continues for several selection periods or for several selection periods plus a period shorter than one selection period. Such an OFF period is sufficient for the setting of the output current of the transistor Q1, even though each selection period is required to be short for the sake of the time-division gradation display. In other words, time required for the output current setting is secured by carrying out the output current setting over the selection periods, each of which is required to be short for the sake of the time-division gradation. Moreover, gradation error is reduced in cases where the output current setting is carried out during the longest sub-frame period. However, a too long current setting period causes a big gradation error, so that it is preferable that the output current setting period corresponds to several selection periods or so.

Note that the aforesaid embodiments explain the structure using the organic EL element as the current driving type display element. However, the present invention is applicable to a display apparatus using another current driving type display element, such as an FED.

FIG. 28 and FIG. 29 illustrate examples in which such a pixel is driven in accordance with the time-division gradation driving methods described in US Patent Publication 2003/0197667 A1 and in Japanese Laid-Open Patent Publication *Tokukai* 2004-271899, respectively.

FIG. 28 illustrates a case where the number of the driving data D is eight, and where gradation of an image to be displayed is 64. When the sets of the driving data D are displayed in order of D6, D5, D4, D1, D0, D2, D3, and D7 and the number of the selection wires is 320, ratio of weights of the sets of the driving data D is:

D6:D5:D4:D1:D0:D2:D3:D7=507:468:429:78:39:156:273:546, in other words, D6:D5:D4:D1:D0:D2:D3:D7=13:12:11:2:1:4:7:14. (To be accurate, the gradation is 65 in the case of this ratio.)

As such, there are 39 selection periods for the driving data D0, so that no big gradation error is caused by the occurrence of the non-display period over several selection periods as shown in FIG. 27.

Therefore, in the case of using the time-division gradation driving method described in US Patent Publication 2003/0197667 A1, there are found many weight ratio patterns of the driving data D, i.e., such weight ratio patterns that the successive eight data to be supplied to the data wires Dj respectively include the driving data D0 through Dn-1. Examples of the patterns include: (i) D0 D1:D2:D3:D4:D5:D6:D7=12:13:1:4:7:2:12:13; (ii) D0:D1:D2:D3:D4:D5:D6:D7=12:13:12:2:7:4:1:13; (iii) D0:D1:D2:D3:D4:D5:D6:D7=13:14:7:4:1:2:11:12; and the like.

FIG. 29 illustrates a case where the number of the driving data D is ten, and where the number of gradation of an image to be displayed is 256. When the sets of the driving data D are displayed in order of D8, D5, D2, D3, D0, D4, D1, D6, D7, and D9, ratio of weights of the sets of the driving data D is:

D6:D5:D4:D1:D0:D2:D3:D7=507:468:429:78:39:156:273:546, in other words, D6:D5:D4:D1:D0:D2:D3:D7=13:12:11:2:1:4:7:14. (To be accurate, gradation is 261 in the case of this ratio.)

Therefore, in the case of using the time-division gradation driving method described in US Patent Publication 2003/0197667 A1, there are found many weight ratio patterns of the driving data D, i.e., such weight ratio patterns that the successive ten data to be supplied to the data wires Dj respectively include the driving data D0 through Dn-1. Examples of the patterns include: (i) D0:D1:D2:D3:D4:D5:D6:D7=48:48:48:8:1:16:2:4:32:53; (ii) D0:D1:D2:D3:D4:D5:D6:D7=51:32:4:8:1:2:16:48:47:51; and the like.

Overview of Embodiments

A first display apparatus includes: A display apparatus includes: (i) a plurality of pixels, provided in a matrix manner, each of the pixels including a current driving type display element; (ii) selection lines for supplying a selection signal for selecting the pixels; and (iii) data lines for supplying data to selected pixels, each of the pixels including: (i) a first transistor for controlling a current; (ii) a second transistor, provided in series with the first transistor and the display element, for supplying or stopping supplying of a current to the display element; (iii) a current setting circuit for setting an output current of the first transistor; and (iv) a driving circuit for turning ON or OFF of the second transistor so as to carry out a time-division gradation driving, the current setting circuit setting of the output current of the first transistor during a period in which the second transistor is OFF, the second transistor being turned OFF in response to OFF data, at least one of driving data, for use in the time-division gradation driving, being the OFF data.

As such, the second transistor is used for the time-division gradation display, and receives the OFF data that is a part of the time-division gradation data. While the second transistor is OFF, the setting of the output current of the first transistor is carried out. Therefore, the second transistor can be used both for (i) the time-division gradation display and (ii) the setting of the output current of the first transistor. This allows reduction of the required number of transistors.

Further, the period during which the second transistor is OFF corresponds to (i) several selection periods or longer; or (ii) several selection periods plus a period shorter than one selection period, or longer. Such a period is sufficient for the setting of the output current of the first transistor even though each selection period is required to be short for the sake of the time-division gradation display.

It is preferable that the display apparatus be arranged as the following first structure or the second structure.

The first structure is arranged such that each of the pixels further includes (i) a third transistor for connecting or disconnecting (a) a control terminal of the first transistor, and (b) a node of the first transistor and the second transistor; and (ii) a capacitor provided between the control terminal of the first transistor and a potential wire; and the current setting circuit (i) supplies a predetermined potential to the potential wire such that the third transistor becomes ON, and the control terminal of the first transistor is caused to have a threshold potential, so that the third transistor turns OFF, and (ii) changes a potential to be supplied to the potential wire.

In the structure, the output current of the first transistor is set, after compensating the threshold voltage of the first transistor, by changing a voltage of a terminal of the capacitor connected to the control terminal of the first transistor. Specifically, while the second transistor is ON by the supply of the ON data, a predetermined potential is supplied to the potential wire so as to turn ON the third transistor. This short-circuits, via the third transistor, (i) the control terminal of the first transistor, and (ii) the node (e.g., a drain terminal of the first transistor) of the first transistor and the second transistor. Accordingly, the potential of the control terminal of the first transistor is decreased to be an ON potential. Thereafter, the OFF data is supplied to the second transistor so as to turn OFF the second transistor. This causes an increase in the potential of the node (the drain terminal of the first transistor). Accordingly, the potential of the control terminal of the first transistor is increased, with the result that the first transistor becomes OFF. On this occasion, the potential of the control terminal of the first transistor is regarded as the threshold potential.

Thereafter, the third transistor is turned OFF, and the potential of the potential wire is changed (when the first transistor is a p-type transistor, the potential is decreased). With this, the first transistor allows a current to constantly flow therethrough irrespective of the threshold potential of the first transistor.

With this structure, the current setting period of the first transistor may continue for a plurality of the selection periods (periods during which the selection lines are selected for sake of displaying an image on pixels respectively connected to the selection lines). Therefore, even in cases where the threshold compensation period of the first transistor is long, each of the selection periods can be arbitrarily shortened irrespective of the threshold compensation period.

Further, in the above structure, it is preferable that a low potential is supplied to the node of the first transistor and the second transistor when the third transistor is turned ON. With this, no current flows into the display element while setting the output current of the first transistor.

The second structure is arranged such that each of the pixels further includes (i) a third transistor for connecting or disconnecting (a) a control terminal of the first transistor, and (b) a node of the first transistor and the second transistor; and (ii) a fourth transistor for connecting and disconnecting (1) a current supply line and (2) a node of the first transistor and the second transistor; and such that the current setting circuit turns ON the third transistor and the fourth transistor so as to allow a predetermined current to flow from the first transistor to the current supply line, so that the current setting circuit turns OFF the third transistor and the fourth transistor after setting the control terminal of the first transistor to a potential corresponding to the predetermined current.

In this structure, the output current of the first transistor is determined by causing a predetermined current to flow through the first transistor. Specifically, when the second transistor is OFF by the supply of the OFF data, the third transistor and the fourth transistor are turned ON, and a current having a predetermined value is caused to flow from the first transistor to the current supply line. The current thus flowing determines the potential of the first transistor because the value of the potential of the control terminal corresponds to the value of the current. Then, the third transistor and the fourth transistor are turned OFF, with the result that the output current of the first transistor is set. With this, the first transistor allows a current to constantly flow therethrough, irrespective of the threshold voltage and the mobility thereof.

With this structure, the current value setting operation of the first transistor is carried out by way of the maximum current (a current value attaining 256 gradation in the case of 256 gradation display), so that the current value corresponding to the potential of the first transistor is several μA. This makes it possible to shorten the time for the setting of the current value.

In the structure, it is preferable that each of the pixels further includes (i) a third transistor for connecting or disconnecting (a) a control terminal of the first transistor, and (b) a node of the first transistor and the second transistor; and (ii) a fourth transistor for connecting and disconnecting (1) a current supply line and (2) a node of the first transistor and the second transistor; and (iii) a capacitor; and (iv) a fifth transistor, the capacitor and the fifth transistor being provided in series between the control terminal of the first transistor and the current supply line; and is preferable that the current setting circuit (i) turns ON the third transistor and the fifth transistor so as to allow the current supply line to receive a predetermined potential, so that a threshold voltage of the first transistor is set, (ii) turns OFF the third transistor and turns ON the fourth transistor so as to allow the predetermined potential to change, such that a predetermined current flows from the first transistor via the current supply line, and the control terminal of the first transistor has a potential corresponding to the predetermined current, and then (iii) turns OFF the fourth transistor and the fifth transistor.

In this structure, a predetermined potential is supplied to the current supply line for the sake of setting the threshold potential of the first transistor, and then the potential to be supplied to the current supply line is changed such that a current having a predetermined value flows from the first transistor. With this, as is the case with the foregoing structure, the setting of the output current of the first transistor enables that the first transistor allows a current to constantly flows therethrough irrespective of the threshold voltage and the mobility thereof. Further, in the structure, the potential of the current supply line is changed before and after the threshold potential setting of the first transistor. This makes it possible to quickly charge the stray capacitance in the current supply line, so that the setting of the output current of the first transistor can be carried out in a shorter period of time.

Further, in the structure and the second structure, it is preferable that each of the data lines for supplying the driving data, and the current supply line are shared with each other. This allows reduction of the number of wires. Moreover, for the purpose of avoiding shorter data transfer time of such a common wire serving as the data line and the current supply line, the data transfer time is so set as to be constant, and the time for supplying data to the data line is adjusted with the use of a latch or the like.

Any of the above display apparatuses carry out the time-division gradation display by turning ON or OFF the second transistor, after setting the output current of the first transistor as above, during a single selection period.

Further, a second display apparatus includes: A display apparatus includes: (i) a plurality of pixels, provided in a matrix manner; each including a current driving type display element; (ii) selection lines for supplying a selection signal for selecting the pixels; and (iii) data lines for supplying data to selected pixels, each of the pixels including: (i) a first transistor for controlling a current; (ii) a second transistor, provided in series with the first transistor and the display element, for supplying or stopping supplying of a current to the display element; (iii) a current setting circuit for setting an output current of the first transistor; (iv) a driving circuit for turning ON or OFF of the second transistor so as to carry out a time-division gradation driving; and (v) a third transistor provided in series with the second transistor, the current setting circuit setting the output current of the first transistor while the third transistor is OFF.

By providing the third transistor and the second transistor in series in this way, the output current of the first transistor can be set irrespective of whether the second transistor is ON or OFF.

The period during which the third transistor is OFF continues for several selection periods or longer, so that such a period is sufficient for the setting of the output current of the first transistor even though each selection period is required to be short for the sake of the time-division gradation display.

In any of the display apparatuses, it is preferable that successive n data to be supplied to the respective data lines include the driving data D0 through Dn-1, for use in the time-division gradation driving, respectively, n being an integer equal to or larger than 2.

With such driving, the driving data are always supplied to the respective data lines. This makes it possible to maximize time in which the driving data are supplied to the respective data lines.

This indicates that the selection time can be longer by way of the maximized time. In cases where the length of the selection period is unchanged even though it can be longer, a larger number of the driving data can be displayed. This is preferable because a better multiple gradation display can be attained.

Further, the aforesaid first structure is described as follows in terms of the pixel.

That is, a display apparatus includes: (1) selection lines for selecting current driving type display elements to be displayed; (2) display elements, each provided in a matrix manner to correspond to respective intersectional points of (i) the selection lines and (ii) data lines for supplying data to selected pixels; (3) first and second transistors, provided in series between (i) a power supply wire for supplying a power supply voltage, and (ii) each of the display elements; (4) a third transistor for connecting or disconnecting (i) a control terminal of the first transistor, and (ii) a node of the first transistor and the second transistor; (5) a capacitor provided between (i) the control terminal of the first transistor and (ii) a potential wire to which a predetermined potential is supplied; and (6) a fourth transistor, provided between (i) a control terminal of the second transistor, and (ii) each of the data lines, the control terminal being connected to each of the selection lines.

The use of the pixel thus arranged allows realization of the first structure.

Further, the aforesaid second structure is described as follows in terms of the pixel.

That is, a display apparatus includes: (1) selection lines for selecting current driving type display elements to be displayed; (2) display elements, each provided in a matrix manner to correspond to respective intersectional points of (i) the selection lines and (ii) data lines for supplying data to selected pixels; (3) first transistor and second transistor, provided in series between (i) a power supply wire for supplying a power supply voltage, and (ii) each of the display elements; (4) a third transistor for connecting or disconnecting (i) a control terminal of the first transistor, and (ii) a node of the first transistor and the second transistor; (5) a fourth transistor for connecting or disconnecting a current supply wire and the node; and (6) a fifth transistor, provided between a control terminal of the second transistor and the data line, the control terminal being connected to each of the selection lines.

The use of the pixel thus arranged allows realization of the second structure.

The present invention is not limited to the embodiments above, but may be altered within the scope of the claims. An embodiment based on a proper combination of technical means disclosed in different embodiments is encompassed in the technical scope of the present invention.

What is claimed is:

1. A display apparatus, comprising:

a plurality of pixels, provided in a matrix manner, each of the pixels including a current driving type display element;

selection lines for supplying a selection signal for selecting the pixels; and data lines for supplying data to selected pixels, each of the pixels including:

a first transistor for controlling a current;

a second transistor, provided in series with the first transistor and the display element, for supplying or stopping supplying of a current to the display element;

a current setting circuit for setting an output current of the first transistor; and a driving circuit for turning ON or OFF of the second transistor so as to carry out a time-division gradation driving, the current setting circuit (i) setting the output current of the first transistor during one of a plurality of sub-frames, constituting a single frame, in which non-emitting data is always provided to the second transistor and the second transistor is turned from an ON state to an OFF state so that a gate voltage of the first transistor is changed to determine a threshold potential of the first transistor, and (ii) maintaining setting of the output current of the first transistor in remaining sub-frames of the single frame, when the time-division gradation driving is carried out.

2. The display apparatus as set forth in claim 1, wherein:

each of the pixels further includes (i) a third transistor for connecting or disconnecting (a) a control terminal of the first transistor, and (b) a node of the first transistor and the second transistor; and (ii) a capacitor provided between the control terminal of the first transistor and a potential wire; and the current setting circuit (i) supplies a predetermined potential to the potential wire such that the third transistor becomes ON, and the control terminal of the first transistor is caused to have a threshold potential, so that the third transistor turns OFF, and (ii) changes a potential to be supplied to the potential wire.

3. The display apparatus as set forth in claim 2, wherein:

successive n data to be supplied to the data lines include driving data D0 through Dn-1 for use in the time-division gradation driving, respectively, n being an integer equal to or larger than 2.

4. The display apparatus as set forth in claim 2, wherein:

the current setting circuit supplies a low potential to the node of the first transistor and the second transistor, while the third transistor is ON.

5. The display apparatus as set forth in claim 4, wherein:

successive n data to be supplied to the respective data lines include the driving data D0 through Dn-1, for use in the time-division gradation driving, respectively, n being an integer equal to or larger than 2.

6. The display apparatus as set forth in claim 1, wherein:

each of the pixels further includes (i) a third transistor for connecting or disconnecting (a) a control terminal of the first transistor, and (b) a node of the first transistor and the second transistor; and (ii) a fourth transistor for connecting and disconnecting (1) a current supply line and (2) a node of the first transistor and the second transistor; and the current setting circuit turns ON the third transistor and the fourth transistor so as to allow a predetermined current to flow from the first transistor to the current supply line, so that the current setting circuit turns OFF the third transistor and the fourth transistor after setting the control terminal of the first transistor to a potential corresponding to the predetermined current.

7. The display apparatus as set forth in claim 6, wherein:

each of the data lines for supplying the driving data, and the current supply line are shared with each other.

8. The display apparatus as set forth in claim 7, wherein:

successive n data to be supplied to the respective data lines include the driving data D0 through Dn-1, for use in the time-division gradation driving, respectively, n being an integer equal to or larger than 2.

9. The display apparatus as set forth in claim 6, wherein:

successive n data to be supplied to the respective data lines include the driving data D0 through Dn-1, for use in the time-division gradation driving, respectively, n being an integer equal to or larger than 2.

10. The display apparatus as set forth in claim 1, wherein:

each of the pixels further includes (i) a third transistor for connecting or disconnecting (a) a control terminal of the first transistor, and (b) a node of the first transistor and the second transistor; and (ii) a fourth transistor for connecting and disconnecting (1) a current supply line and (2) a node of the first transistor and the second transistor; and (iii) a capacitor; and (iv) a fifth transistor, the capacitor and the fifth transistor being provided in series between the control terminal of the first transistor and the current supply line; and the current setting circuit (i) turns ON the third transistor and the fifth transistor so as to allow the current supply line to receive a predetermined potential, so that a threshold voltage of the first transistor is set, (ii) turns OFF the third transistor and turns ON the fourth transistor so as to allow the predetermined potential to change, such that a predetermined current flows from the first transistor via the current supply line, and the control terminal of the first transistor has a potential corresponding to the predetermined current, and then (iii) turns OFF the fourth transistor and the fifth transistor.

11. The display apparatus as set forth in claim 10, wherein:

each of the data lines for supplying the driving data, and the current supply line are shared with each other.

12. The display apparatus as set forth in claim 11, wherein:

successive n data to be supplied to the respective data lines include the driving data D0 through Dn-1, for use in the time-division gradation driving, respectively, n being an integer equal to or larger than 2.

13. The display apparatus as set forth in claim 11, wherein:

successive n data to be supplied to the respective data lines include the driving data D0 through Dn-1, for use in the time-division gradation driving, respectively, n being an integer equal to or larger than 2.

14. The display apparatus as set forth in claim 1, wherein:

successive n data to be supplied to the data lines include driving data D0 through Dn-1 for use in the time-division gradation driving, respectively, n being an integer equal to or larger than 2.

15. A display apparatus, comprising:

selection lines for selecting current driving type display elements to be displayed;

display elements, each provided in a matrix manner to correspond to respective intersectional points of (i) the selection lines and (ii) data lines for supplying data to selected pixels;

first and second transistors, provided in series between (i) a power supply wire for supplying a power supply voltage, and (ii) each of the display elements;

a third transistor for connecting or disconnecting (i) a control terminal of the first transistor, and (ii) a node of the first transistor and the second transistor;

a capacitor provided between (i) the control terminal of the first transistor and (ii) a potential wire to which a predetermined potential is supplied;

a fourth transistor, provided between (i) a control terminal of the second transistor, and (ii) each of the data lines, the control terminal being connected to each of the selection lines;

a current setting circuit for setting an output current of the first transistor; and a driving circuit for turning ON or OFF of the second transistor so as to carry out a time-division gradation driving, the current setting circuit (i) setting the output current of the first transistor during one of a plurality of sub-frames, constituting, a single frame, in which non-emitting data is always provided to the second transistor and the second transistor is turned from an ON state to an OFF state so that a gate voltage of the first transistor is changed to determine a threshold potential of the first transistor, and (ii) maintaining setting of the output current of the first transistor in remaining sub-frames of the single frame, when the time-division gradation driving is carried out.

* * * * *